US007070362B2

(12) United States Patent
Rasmussen

(10) Patent No.: US 7,070,362 B2
(45) Date of Patent: Jul. 4, 2006

(54) REINFORCEMENT UNIT FOR A REINFORCING A FOOTING ELEMENT WHEN LAYING PILE FOUNDATIONS WITH A PILE, AND METHOD FOR PLACING A FOUNDATION PILE AND REINFORCEMENT OF A FOOTING ELEMENT

(76) Inventor: Henning Baltzer Rasmussen, Danas Allë 11, DK-8700 Horsens (DK)

( * ) Notice: Subject to any disclaimer, the term of this patent is extended or adjusted under 35 U.S.C. 154(b) by 0 days.

(21) Appl. No.: 10/502,286

(22) PCT Filed: Jan. 22, 2003

(86) PCT No.: PCT/DK03/00037

§ 371 (c)(1),
(2), (4) Date: Feb. 9, 2005

(87) PCT Pub. No.: WO03/062539

PCT Pub. Date: Jul. 31, 2003

(65) Prior Publication Data

US 2005/0117977 A1 Jun. 2, 2005

(30) Foreign Application Priority Data

Jan. 22, 2002 (DK) ..... 2002 00111
Sep. 6, 2002 (DK) ..... 2002 01313
Sep. 25, 2002 (DK) ..... 2002 01413

(51) Int. Cl.
*E02D 5/74* (2006.01)
*E02D 7/02* (2006.01)

(52) U.S. Cl. ..... 405/232; 405/233; 52/155; 52/160

(58) Field of Classification Search ..... 405/231–235, 405/244, 252.1, 255, 257; 52/153–156, 160, 52/169.9

See application file for complete search history.

(56) References Cited

U.S. PATENT DOCUMENTS

| | | | | | |
|---|---|---|---|---|---|
| 727,335 | A | * | 5/1903 | Fisher | 52/160 |
| 1,366,460 | A | * | 1/1921 | Howell | 405/248 |
| 2,431,608 | A | * | 11/1947 | Clapper | 52/161 |
| 2,947,149 | A | | 8/1960 | Barkley, Jr. | |
| 2,966,243 | A | * | 12/1960 | Clapper | 52/161 |
| 3,276,173 | A | | 10/1966 | Bowman et al. | |
| 3,526,069 | A | * | 9/1970 | Deike | 52/160 |
| 3,763,655 | A | * | 10/1973 | Galuska | 405/244 |
| 3,832,859 | A | | 9/1974 | Kanjanavanlt | |
| 3,924,371 | A | | 12/1975 | Kidwell | |
| 3,935,912 | A | | 2/1976 | Shibata | |
| 3,974,604 | A | * | 8/1976 | Conn et al. | 52/160 |
| 4,000,623 | A | | 1/1977 | Meardi | |

(Continued)

FOREIGN PATENT DOCUMENTS

| | | |
|---|---|---|
| DE | 96 328 | 11/1953 |

(Continued)

*Primary Examiner*—Jong-Suk (James) Lee
(74) *Attorney, Agent, or Firm*—Antonelli, Terry, Stout and Kraus, LLP.

(57) ABSTRACT

The invention is a reinforcement unit for reinforcing a footing element by laying a pile foundation with a foundation pile with at least one through-going longitudinal cavity and a method for placing the foundation pile and reinforcing a footing element with the reinforcement unit. The reinforcement unit includes at least one shaped and articulated reinforcement member that is pivotably connected to a centrally arranged, annular element, so that the reinforcement unit has a folded mounting position and an extended position of use, and is connected to the foundation pile by one or more tension members.

33 Claims, 21 Drawing Sheets

U.S. PATENT DOCUMENTS

| | | | | | |
|---|---|---|---|---|---|
| 4,060,994 | A | | 12/1977 | Chitis | |
| 4,189,879 | A | | 2/1980 | Patterson | |
| 4,228,627 | A | | 10/1980 | O'Neill | |
| 4,593,500 | A | * | 6/1986 | Watson | 52/155 |
| 4,644,712 | A | | 2/1987 | Watson | |
| 4,723,875 | A | | 2/1988 | Sutton | |
| 5,217,194 | A | * | 6/1993 | Brownell | 52/160 |
| 5,975,808 | A | | 11/1999 | Fujita | |
| 6,047,505 | A | | 4/2000 | Willow | |
| 6,062,771 | A | * | 5/2000 | Roberts | 405/232 |

FOREIGN PATENT DOCUMENTS

| | | | | |
|---|---|---|---|---|
| FR | 2 008 233 | | 5/1969 | |
| GB | 1 465 866 | | 3/1977 | |
| GB | 2131071 | * | 6/1984 | |
| JP | 61068931 | | 4/1986 | |
| JP | 62268423 | * | 11/1987 | 405/244 |
| SE | 5155997 | | 11/2001 | |

* cited by examiner

REINFORCEMENT UNIT FOR A REINFORCING A FOOTING ELEMENT WHEN LAYING PILE FOUNDATIONS WITH A PILE, AND METHOD FOR PLACING A FOUNDATION PILE AND REINFORCEMENT OF A FOOTING ELEMENT

FIELD OF THE INVENTION

The present invention concerns a reinforcement unit for reinforcing a footing element when laying pile foundations with a foundation pile with at least one through-going longitudinal cavity, said reinforcement unit includes a number of shaped and articulated reinforcement members that are pivotally connected to a centrally arranged, annular element, so that the reinforcement unit has a folded mounting position and an extended position of use, and that the reinforcement unit is connected to the foundation pile by one or more tension members.

The invention also concerns a method for placing a foundation pile and reinforcing a footing element with a reinforcement unit.

BACKGROUND OF THE INVENTION

For building large constructions as e.g. houses, walls, tower elements, and similar building structures, typically a foundation supported by a number of foundation piles is used, where the piles are placed in the ground for supporting the foundation and for absorbing the compressing and tensile forces caused by the constructions due to their dead weight and wind load.

For absorbing the compressive forces, typically smooth foundation piles are used that are driven down into the earth until they hit a firm substratum. This implies that in some places, many meters of foundation pile are to be used before the bottom reaches a firm bed. Therefore, this method may be a very expensive way of founding a building construction on.

By building in areas where earth surveys show that a firm bed is far down, another type of foundation pile is used, where the foundation pile is provided at its lower end with a footing element having a diameter larger than the diameter of the foundation pile itself. This means that the foundation pile is provided a large area over which the pressure is distributed, and that the footing element makes it more difficult for the pressure caused by the dead weight of the building structures to press the foundation pile farther down into the ground.

Since it is not possible to drive down a foundation pile with enlarged footing element or to press such a foundation pile down through a pre-drilled hole, different solutions have been found as to how the foundation pile is disposed in the desired position before the enlarged reinforcement unit is produced.

Such a foundation pile is known from U.S. Pat. No. 3,832,859 where a foundation pile has a reinforcement unit designed so that by driving down it may spread a number of legs out into the earth layer, after which the pile foot may be cast for formation of a footing element with a dimension greater than the diameter of the foundation pile.

A drawback by using either smooth foundation poles or foundation piles with enlarged footing elements compared with the outer periphery of the foundation pile as described in U.S. Pat. No. 3,832,859 is that these foundation piles are not suited for absorbing tensile forces.

These tensile forces arise when a building section or a tower element is for example subjected to wind forces, whereby the foundation piles in the lee side will be exposed to compressive forces while the foundation piles to windward will be exposed to tensile forces.

If the foundation piles can absorb tensile forces, it is an advantage that the foundation piles longitudinally have one or more beads and/or a footing element, which have greater diameter than the foundation pile itself, at one or more points. The increased diameter of the beads/footing element compared with the foundation pile implies that the foundation pile may absorb larger tensile forces than a smooth foundation pile, as the beads/footing element are acted on by the mass of earth that is distributed in an upwards directed conical shape above the beads/footing element.

By using smooth foundation piles, these will only absorb tensile forces provided by the suction of the earth. This suction appears when a foundation pile, due to the resisting force between the surrounding earth layer and the surface of the foundation pile, is pulled out from it position, whereby subpressure occurs in the hole from which the foundation pile is removed.

There are different ways in which the beads/footing element may be provided in connection with a foundation pile placed in the ground. One possibility is that the foundation pile has a longitudinally through-going duct through which there is pressed a curable filler out into the earth, either at the lower part of the foundation pile or via transverse filling ducts along the length of the foundation pile.

In order that these beads footing element can withstand the increased tensile strength, it is typically reinforced with a reinforcement unit. In U.S. Pat. No. 3,832,859 is described how a reinforcement unit is designed so that by pressing down the unit spreads a number of legs out into the earth layer which subsequently are cast for formation of a footing element with a larger diameter than the diameter of the foundation pile.

A disadvantage of using such a reinforcement unit with the footing element of the foundation pile is that in this case the reinforcement will be disposed at the top of the reinforcing unit, which implies that the reinforcement is poorly distributed in the footing element and thereby is only attained a slight increase in the tensile strength. In order to attain optimal strength of the footing element, the reinforcement members of the reinforcement unit are to be distributed over the largest possible area of the footing element.

By using a foundation pile according to U.S. Pat. No. 3,832,859, the foundation pile will have a certain strength in relation to the tensile forces, but particularly in clay ground it will be prominent due to its design, and the foundation pile may release itself from the cast footing element, and thereby the design of the reinforcement unit will provide that the legs spread in the earth layer by upwards pull in the foundation pile will not hold, and thereby the reinforcement unit will fold with the result that the same resistance against the tensile forces is achieved as by a smooth foundation pile.

SUMMARY OF THE INVENTION

It is therefore the purpose of the present invention to provide a reinforcement unit which is easy to provide at the foot of a foundation pile, and which in a secure and easy way provides for even distribution of reinforcement in the footing element.

A further purpose of the invention is to provide a foundation pile having good compressive and tensile proportions and where it is possible to adapt the foundation piles to the actual condition prevailing in the soil.

This is achieved by a reinforcement unit of the kind described above which is peculiar in that the reinforcement unit in the mounting position is adapted for passing through the through-going longitudinal cavity of the foundation pile.

Furthermore, the present invention provides a foundation pile that may absorb the required tensile and compressive forces, and which furthermore is easy and cheap to make and to place in the desired position.

This is achieved by a foundation pile of the kind being peculiar in the said footing element optionally includes a pile foot and the reinforcement unit and/or the pile foot is connected with the foundation pile with one or more tension members.

A further purpose of the invention is to indicate a method for easy and cheap placing of a foundation pile, and to indicate a method for a more secure reinforcement of a footing element with a reinforcement unit.

This is achieved by a method being peculiar in that the placing and reinforcing includes that a folded reinforcement unit is pressed down through the at least one through-going longitudinal cavity in the foundation pile, when the reinforcement unit reaches the bottom of the foundation pile, it is pressed a distance farther down, and the means for expanding the reinforcement members are activated, thereby forming a network at least of the reinforcement members, and curable filler is pressed down through the at least one through-going longitudinal cavity in the foundation pile, so that the lower part of the foundation pile and the expanded reinforcement unit are cast in one for formation of a reinforced footing element with larger dimension than the outer dimension of the foundation pile.

In the following is described a foundation pile with a footing element, which is reinforced with a reinforcement unit, for supporting a windmill and a method for placing such a foundation pile and reinforcing such a footing element, but the coupled elements of the invention may also be used by laying foundation to other kinds of tower elements, for example chimneys, large flagpoles, columns, power pylons and antennae. The foundation pile may also be used for laying foundation under houses, bridges, offshore platforms and the like.

In order to press a reinforcement unit down through a through-going longitudinal cavity in a foundation pile and simultaneously attain reinforcement fills being distributed as greatly as possible in the footing element, the reinforcement includes an expanding element. This implies that the reinforcement unit, when placed under the bottom of the foundation pile, can expand and thereby produce a network of reinforcement which can be cast into a footing element.

The expanding element according to the invention is a number of articulated reinforcement members that are pivotably connected to a centrally arranged, annular element, so that the reinforcement unit has a folded mounting position and an extended position of use. This implies that the reinforcement unit after making can be placed in the through-going, longitudinal cavity of the foundation pile during for example transport and be removed again when the foundation pile is placed in the earth.

By the articulated reinforcement members being pivotably connected to a centrally arranged, annular member, the reinforcement members of the reinforcement unit will, when the reinforcement unit is in a folded mounting position, be used as guides against the inner side of the through-going longitudinal cavity of the foundation pile by pressing down the reinforcement unit.

In order to transmit tensile forces from the footing element up to the foundation, the reinforcement unit includes a number of tension members arranged so that they run from the reinforcement unit and up to the foundation, whereby the reinforcement unit is connected to the foundation pile.

In order to transmit the tensile forces from the tower element to the reinforcement unit in the footing element, the tension members fastened at one end to the foundation and at the other end to the reinforcement unit are used. These tension members are provided as wires, cables, threaded rods and/or round bar iron with bolt end or other fixation. The choice of type of tension member may be made according to need depending on the foundation used and how long the foundation piles are, and on the soil conditions.

In an embodiment of the invention, the reinforcement unit further includes a number of pipes, where a tension member is disposed through each pipe and fastened to a lower end of the pipe and one or more reinforcement elements with means for fastening. Downwards, the tension member are each passed through a pipe and fastened to the reinforcement members. The pipes may also be connected to one or more reinforcement members.

These pipes have a length which is longer than or correspond to the extension of the height of the reinforcement unit. This implies that tension members, as for example wires, are protected against tangling, which can cause notch effects whereby the wires will lose some strength and in the worst case break, and at the same time the wires are protected against tangling with the reinforcement members.

In order to control the spreading of the reinforcement members, each pipe is connected with one or more of these reinforcement members. This implies that outward spreading of the reinforcement members will be achieved in relation to the center of the foundation pile, and this spreading will be evenly distributed in relation to the number of pipes with which the reinforcement unit are provided.

In order to ensure that the lower edge of the foundation pile is not to cut down into the underlying footing element and destroyed when the foundation pile is subjected to compressive forces, the reinforcement unit furthermore includes a number of retainer elements, which retainer elements are fastened to an upper end of one or more pipes and are provided with a cross-sectional shape with at least one retainer surface.

The retainer elements are designed so that their cross-sectional shape includes at least one retainer surface. In one embodiment, there is used a cut-up, preferably annular angle iron with an upright part and an approximately horizontal part, where the upright part will be connected to one or more pipes whereas the horizontal part is forming the retainer surface. During pressing down of the folded reinforcement unit, the reinforcement members can produce spacing between the pipes of the reinforcement unit and the inner side of the through-going longitudinal cavity in the foundation pile.

The retainer surface is used when the reinforcement unit has reached down under the bottom of the foundation pile and has expanded, whereby the angle iron will lie with its upright part against the inner side of the through-going longitudinal cavity in the foundation pile, whereas the horizontal part will be placed under the lower edge of the foundation pile and thereby form a retainer against tensile forces in the tension members.

The cross-sectional shape of the retainer elements is typically L-shaped, but may alternatively be U- or C-shaped, or plane. However, a certain aperture may be allowed between the upright facing end pieces so that it is ensured that the lower edge of the foundation pile always fall into the retainer element and against the retainer surface.

In an embodiment of the invention, the retainer elements are connected to the upper end of the pipes and may function as guides together with the reinforcement members and hold the pipes in place during pressing down of the reinforcement unit in the through-going longitudinal cavity in the foundation pile.

In order to control and guide the reinforcement member during expansion, in an embodiment of the invention the reinforcement unit is designed so that the connection between pipes and reinforcement members are provided as a complete or partial eye joint. This design provides that the reinforcement members can be secured to the pipes but simultaneously allow that the reinforcement elements can slide in the eye connection so that they can be pressed outwards in relation to the center of the foundation pile.

Each pipe may be provided with plural eye joints so that a pipe is connected to e.g. two reinforcement members. This implies that more reinforcement members than pipes may be provided in the reinforcement unit, which causes better reinforcement of the footing element.

In order that a cast reinforcement unit is to transmit tensile force to the foundation, the tension members running from the reinforcement unit up to the foundation are to be fastened to at least a part of the reinforcement unit with means for fastening, the means for fastening a tension member to a pipe being one or more of the following: a bolt joint, a press joint and/or a welding.

In an embodiment of the invention, the tension member is a wire fastened to the lower end of the pipe and the reinforcement member by means of a bolt joint which is disposed at the underside of the reinforcement members. This bolt joint may be self-locking so that loosening of the wires from the reinforcement unit cannot occur when tension arises in the wire.

In a second embodiment of the invention, the tension member is a wire which is fastened to the lower end of the pipe and the reinforcement members by means of a press joint, which typically will be a wire clamp disposed at the underside of the reinforcement members. These wire clamps will abut against the underside of the reinforcement members and thereby prevent loosening of the wires when the wires are subjected to tension.

In a third embodiment of the invention, the tension member is a wire, cable, threaded rod or round bar iron fastened to the underside of the reinforcement member by means of a welding. This welding is to be performed so that the tension members are not weakened in themselves by the action of heat occurring by welding.

Another way of ensuring that the lower edge of the foundation pile is not cutting down into the underlying footing element and destroying this when the foundation pile is subjected to compressive forces is that the reinforcement unit furthermore includes a number of retainer elements which are fastened to a folding arrangement in the tension member and is provided with a cross-sectional shape with at least one retainer surface.

The tension members are here divided into an upper part running from the foundation and down into the area approximately in the vicinity of the lower edge of the foundation pile and a lower part having a length approximately corresponding to the height of the folded reinforcement unit. These two parts of the tension members are joined with an assembly arrangement. In connection with this assembly arrangement there are provided retainer elements.

In order to join the upper and lower parts of a tension member, the assembly arrangement in the tension member is one or more of the following: a sleeve joint, a press joint and/or a plate/bolt joint.

In an embodiment of the invention, the tension member is a threaded rod which is joined by means of a sleeve joint with internal thread corresponding to the thread of the threaded rod. This implies that the ends of the upper and lower parts of the tension members can be secured in the sleeve joint. The retainer elements may be provided at the outer side of the sleeve joint.

In a second embodiment of the invention, the tension member is a wire which is assembled by means of a press joint. This implies that the ends of the upper and lower parts of the tension members are squeezed together and locked. The retainer elements may be provided at the outer side of the press joint.

In a third embodiment of the invention, the tension member is a round bar iron, which is assembled by means of a plate/bolt joint, where the plate is provided with holes through which the round bar irons are placed and secured by a bolt at the other side of the plate. The retainer elements may be provided in connection with or as a part of the plate.

When the reinforcement unit is placed at its proper position, either at the lower edge of the foundation pile or in the vicinity under the lower part of the foundation pile, the reinforcement unit is to be expanded in order that the reinforcement members are distributed in the footing element.

This expansion of the reinforcement members of the reinforcement unit is achieved in that the reinforcement unit furthermore includes means for expanding the reinforcement members, which means is one or more of the following: a spring ring, an eye joint, an explosion unit and/or a spreading element.

In an embodiment of the invention, the means for expanding the reinforcement members is a spring ring which is to be connected with the pipes and/or reinforcement members in order to have the desired effect, and placed so that when the spring ring expands, it will press the pipes and/or reinforcement members outwards.

When the pipes are pressed outwards, the reinforcement unit of reinforcement members pivotably connected to a centrally arranged annular element, will be forced to spread outwards in relation to the center of the foundation pile.

In an alternative embodiment of the invention, the means for expanding the reinforcement members is an explosion unit which is either disposed inside the reinforcement unit when it is pressed down, or is pressed down separately subsequently.

The main thing is, however, that this explosion unit is placed so that it, when exploding, will have the greatest possible effect on the reinforcement members which are to expand outwards. This means that the explosion unit is to be placed in vicinity of or opposite to the reinforcement members in the reinforcement unit.

By activation of the explosion unit, the pressure from the explosion will act on the reinforcement members so that these spread outwards and thereby form a preferably evenly distributed reinforcement in the footing element.

This explosion unit is to have power so that by the explosion it can exert a necessary pressure on the reinforcement members, but the explosion must not be so great that the reinforcement unit is destroyed or that the tension members are damaged.

In order to achieve secure spreading of the reinforcement member, these are ring-shaped so that both ends of the reinforcement rods are movably folded around the centrally arranged annular element. An advantage of having an annular reinforcement member is that it provides better reinforcement of the footing element than a reinforcement member made of for example a straight round bar iron, as an annular reinforcement member can reinforce the footing element at several levels and not only in one plane.

At the same time, by using annular reinforcement members during pressing down of the reinforcement unit it will be safeguarded against the reinforcement unit does not go into unwanted engagement with irregularities and projections at the inner side of the through-going longitudinal cavity in the foundation pile.

In an embodiment of the invention, the reinforcement members are part of the reinforcement unit holding the lower part in a certain position, both during pressing down of the reinforcement unit and when the reinforcement unit has been placed in desired position. Therefore, the reinforcement members are each shaped as a segment of a ring so that they, when the reinforcement unit is folded, form a ring corresponding to an inner diameter of at least one through-going longitudinal cavity in the foundation pile, and when the reinforcement unit is expanded, form an approximately circular ring having a diameter equal to or greater than the diameter of the bottom of the foundation pile.

These ring-shaped reinforcement members are connected end-to-end so that the pipes are connected to an assembled unit of interconnected annular reinforcement members, where the reinforcement members have different width so that two juxtaposed reinforcement members will have different width. This means that it is possible to put a reinforcement member down into another reinforcement member. The joint between these reinforcement members may for example be constituted by recesses in reinforcement members through which tension member and/or pipe can be passed so that two reinforcement members are connected by a tension member or a pipe. In this way, the reinforcement members, when expanded, will only expand to a certain size which is dependent on the recesses in the reinforcement members.

In a second embodiment of the invention, the reinforcement members are formed by a network of rods and/or wires. This means that it is possible to make reinforcement members that are light and cheap, and which reinforces the footing element at several levels and not only in one plane.

For further reinforcement of the footing element, the reinforcement members may be mutually connected with for example a number of wires so that reinforcement of the footing element is provided between the reinforcement members. This means that the reinforcement of the footing element will be like a spider's web if the footing element is seen in a plan view.

In order easily to provide a foundation pile in the desired position, either by driving and/or vibrating the foundation pile down or placing it in a pre-drilled hole, the foundation pile is preferably cylindric, which means that the cross-sectional area of the foundation pile will be largely the same over its entire length. Thereby is avoided that a cross-sectional change of the foundation pile will form an interspace between the outer side of the foundation pile and the surrounding earth in the areas of the foundation pile lying above the cross-sectional change.

In order to move different work tools down to the bottom of the foundation pile, internally in the foundation pile there is provided a through-going longitudinal cavity, the cross dimension of which being determined by which tool and which tensile and compressive forces that are to be absorbed by the foundation pile.

In order to absorb the tensile forces in the foundation pile, according to the invention it is important that the foundation pile maintains its fastening to the reinforcement unit, and therefore the reinforcement unit is connected to the foundation pile with one or more tension members.

In order to facilitate driving/pressing down a foundation pile in the earth, the reinforcement unit further includes a pile foot disposed at the lower edge of the foundation pile so that the foundation pile acts as an earth rod during the pressing/driving down.

In order to utilize the pile foot as part of the footing element it is important that the reinforcement unit with the footing element is connected to the foundation pile. Therefore, in the foundation pile there is provided a number of through-going, longitudinal side ducts that are disposed with largely uniform spacing from the cross-sectional centre of the foundation pile, that in each side duct there is provided a tension member, that each tension member is fastened downwards with means for fastening to a reinforcement unit including a pile foot, and that the pile foot is releasably connected to the preferably cylindric part of the foundation pile by means of the tension members.

Previously known foundation piles with a separate pile foot do not maintain this connection, which is why it is more difficult to ensure that the enlarged footing element provided by casting around a reinforcement member has sufficient connection between the pile foot and the lower part of the foundation pile.

The pile foot is connected to the foundation pile by means of a number of tension members. In order that these tension members are not disposed externally of the foundation pile or within the through-going longitudinal cavity, there is provided a through-going, longitudinal side duct for each tension member. There is no requirement to the number of tension members, but the tension members are to be distributed evenly with a substantially uniform spacing from the cross-sectional center of the foundation pile and in the side material of the foundation pile.

The dimension of the through-going, longitudinal side ducts is determined by the dimension which the tension members are to have for absorbing the tension forces arising by for example wind action on a tower element fastened to the foundation pile.

For enabling separation of the pile foot and the foundation pile after placing the foundation pile in the desired position, the foundation pile is formed so that the tension members have at least one free section between the lower edge of the foundation pile and the pile foot. This free section of the tension members can have different length, depending on which type of soil, the foundation pile is disposed in, and this will thereby be determining of which size it is possible to form a footing element between the lower part of the foundation pile and the pile foot by injection molding of a curable filler.

For transmitting the tensile forces from the foundation and down through the foundation pile to the pile foot, the tension members are provided as wires, cables and/or rods.

If the tension members are provided as wires or cables, they are mounted in the through-going, longitudinal side ducts, either by the tension members being cast in the side material of the foundation piles at a number of points, or by the tension members being disposed freely in a side duct so that they are provided longitudinal movement in the side ducts.

Wires and/or cables are made of a material having sufficient strength for absorbing the tensile forces, and which furthermore is to be made of a material or finished so to not corrode. Furthermore, it is important the wires/cables during mounting of the tension members in the side ducts do not twist or tangle so that a notch effect can arise in the wire/cable itself when tension occurs, whereby the wire/cable will loose some strength and break in the worst case.

If the tensile members are provided as rods of for example stainless steel and similar material, these rods will be mounted in the through-going, longitudinal side ducts so that they are longitudinally displaceable. This provides for the rods protruding out over the upper edge of the rods when the pile foot is fastened to the lower section of the foundation pile during for example transport, or when the foundation pile is placed in the desired position.

An advantage of using wires/cables is that the connection between foundation pile and foundation adapter/foundation does not have to be 100% accurate, as the wires/cables are flexible and thus may be adjusted laterally and thereby fastened.

Rods as tension members are typically provided with threads at the top so that, by means of a mounting ring, the members can be bolted to a foundation adapter or directly to the building construction.

If wires are used as tension members, the fastening of the tension members to a mounting ring on the foundation may be performed by means of a wire clamp, coiling, welding and/or casting fast to a foundation adapter or similar building construction.

In an embodiment of the invention, the wires will be fastened to a mounting ring or similar mechanism by means of wire clamps which eventually may be tightened so that a tightly clamped wire is provided all the time down through the through-going, longitudinal side ducts and down to the pile foot. It is important that the wires are fully tightened or else a loose connection between the foundation pile and the overlying foundation will cause the building construction to tilt.

In order to fasten the tension members to the pile foot, the means for fastening the tension members to the pile foot is one or more of the following: a bolt joint, a press joint, a sleeve, a casting and/or that a preferably U-shaped duct is provided inside the pile foot through which a tension member may be passed.

In an embodiment of the invention, the tension members are fastened to the pile foot by a bolt joint which typically will be used when the tension members are constituted by rods with thread at the end. This bolt joint may be self-locking so that loosening of the tension member from the pile foot cannot occur.

In a second embodiment of the invention, the means of fastening to a pile foot is a press joint, typically being a wire clamp disposed in recesses inside the pile foot. These recesses inside the pile foot are provided by ducts through the pile foot disposed in straight alignment with the through-going, longitudinal side ducts of the foundation pile.

The ducts in the pile foot are designed so that the diameter in the duct may change, either continuously down through the pile foot, or by the duct being provided with two different diameters, where the largest diameter is at the downwards facing side of the pile foot. This enables providing a wire clamp joint at the lower side of the edge of the pile foot which by means of a change in diameter has a retainer so that the wire is secured in the pile foot.

This assembly will typically be performed so that the pile foot will not have any projection or the like, but only a smooth surface. This is an advantage in disposing the foundation pile in the desired position and by the later positioning of the pile foot itself, as there will nothing to prevent the pointedness of the pile foot from penetrating down into the underlying earth.

In a third embodiment of the invention, the means for fastening tension clamps for the pile foot is a sleeve, where the lower part of the tension members, after mounting through a set of through holes in the pile foot, are bent so that they form a retainer. The bends may be disposed in recesses so that the smooth surface of the pile foot is maintained.

In a fourth embodiment of the invention, the tension members may be cast into the pile foot. For example, during the formation of the pile foot, a part of the tension members are placed in the mould in which the pile foot is cast. The cast part of the tension members may be turned in/bent in order to impart further strength to the pile foot and to strengthen the fastening of the pile foot.

In a fifth embodiment of the invention, there may be provided a number of U-shaped ducts during the casting of the pile foot which are disposed so that inlet/outlet of each of the upwards facing parts of the U-shaped duct fits with two roughly opposite side ducts in the foundation pile.

This provides that a tension member, for example a wire, may extend from the top of the foundation pile down through a through-going, longitudinal side duct, down into the U-duct of the pile foot, and up again through an opposite through-going, longitudinal side duct of the foundation pile. This furthermore provides that no fastening means, such as clamps and joints, are to be provided in the pile foot.

In order to keep the entire foot in place in the through-going, longitudinal cavity and in close connection with the lower part of the foundation pile during transport, mounting and placing, the pile foot is designed so that the pile foot upwards has a top element which in its basic form corresponds to the cross-sectional shape of at least one through-going longitudinal cavity, and that the top element has a tapering shape upwards which is symmetric about the center line of the pile foot.

The shape of the top part provides that the pile foot may be placed and partially fixed in the through-going longitudinal cavity in the lower part of the foundation pile during transport and during placing of the pile foot.

Furthermore, the shape of the top part will imply that the pile foot is disposed in such position that it will be almost impossible to push it aside if the pile foot comes in contact with a stone or the like during placing of the foundation pile. This means ensuring at every the time that the pile foot is centered under the foundation pile.

A further function of the tapering shape is that, when placing a reinforcement unit in the through-going longitudinal cavity, and this is pushed down against the tapering shape, it will force the reinforcement elements of the reinforcement unit to turn outwards and thereby be spread out from the foundation pile.

Downwards, the pile foot is formed so that the pile foot is provided with a tapering shape and/or a flat disc shape. The shape of the downwards facing part of the pile foot is determined by the type of soil in which a foundation pile is to be placed. For example a pile foot with tapering downwards will be used in places where the foundation pile is vibrated, pressed and/or driven into the earth, as the point is assisting with breaking the ground surface. Alternatively, one may use a pile foot shape with a flat disc shape when the foundation pile is placed in a pre-drilled hole.

When the foundation pile is placed in the desired position, it will, for example with a piston, be possible to press the pile foot further down into the earth, so that an interspace is formed between the pile foot and the lower part of the foundation pile corresponding to the free part of the tension members.

Into this area, there will subsequently be pressed or injected a filler that forms an enlarged footing element which has larger diameter than the outer circumference of the foundation pile. This provides that the foundation pile will have greater strength compared with the tensile forces occurring in connection with a cast foundation pile.

For further increasing the strength of this enlarged footing element, a loosely folded reinforcement unit is provided at the lower end of the through-going longitudinal cavity, including a number of articulated reinforcement members that are movably arranged at one end around a centrally arranged annular element, and that the free end of each reinforcement member is shaped so that the end at least projects in over the centre line of the top section of the pile foot.

By having a foundation pile with an internal, through-going, longitudinal cavity, it is possible by subsequent provision of a foundation pile in a desired position to provide strengthening elements or filler so that there may be formed a strong footing element for absorbing tensile forces.

In an embodiment of the invention, the reinforcement unit is designed with a number of reinforcement members which are movably assembled around a central annular element, so that the reinforcement members can rotate about this annular element and spread themselves out from the bottom of the foundation pile.

This central, annular element may be a ring on which is mounted a number of reinforcement members that are fastened by either a ring joint or a pivotably journalled joint.

The reinforcement members are designed so that they have a bent shape providing that a part of the reinforcement member, when the latter is mounted on the central annular element and this is arranged in the through-going longitudinal cavity in the foundation pile, is bent rearwards across the center line of the top section of the pile foot. This bending, together with the upwards tapering shape of the pile foot, causes the reinforcement members, when they are pushed down over the pointed shape of the pile foot, to open and spread in radial direction relative to the center of the pile foot.

The central annular element may be designed so that it has an outer diameter approximately corresponding to the diameter on the longitudinal, through-going cavity, or alternatively have a smaller diameter. In both cases it applies that the reinforcement members are designed so that the members at least at one point, are in a folded condition and by pressing down through the longitudinal, through-going cavity, touch the sides, and that the reinforcement unit is guided during the pressing down.

The centrally arranged annular element may be designed as a circular element with a number of recesses in which the end part of the reinforcement members may be fastened by means of a locking arrangement. This locking arrangement can be a ring that is fastened to a circular element, whereby recesses are closed and the reinforcement members are retained.

By using wires or cables as tension members, there are provided recesses in the pile foot and/or the lower part of the foundation pile for accommodating the free section of the tension members, implying that the wires are not to be displaced up through the foundation pile during placing of the foundation pile. Furthermore, it will be advantageous to have these recesses when the wires are cast fixed at one or more points up through the longitudinal side ducts.

Either in the pile foot or the lower part of the foundation pile there are provided recesses in which the wire can be coiled up/turned up so that it may lie hidden without causing separation of pile foot and foundation pile during transport and mounting of the foundation pile.

These recesses can be designed in immediate vicinity of the inlet holes for the tension members in the pile foot or in recesses at the end of the foundation pile. Uncoiling the free part is to occur so that by pressing the pile foot down, tangling of the wire does not occur, whereby an effect arises when tension is applied to the wire, reducing the tensile ability of the wire.

For further increasing the tensile strength of the foundation pile and reducing the possibility of lateral displacement of the foundation pile, the through-going longitudinal cavity is connected at one or more points with the outer side of the foundation pile with one or more transverse and downwards directed filling ducts.

These filling ducts enable pressing out filler material at certain points along the work duct, i.e. at different levels, and thus providing a bead that thereby form resistance at the outer side of the foundation pile relative to compressive and tensile forces. Alternatively, through these filler ducts there may be extended reinforcing rods which, interacting with injection of curable material, will form a reinforced bead having greater strength than a bead without reinforcement.

These filler ducts can be arranged at different planes perpendicularly to the longitudinal axes of the foundation pile, and typically one or more filler ducts will be placed so that the outlets of the filler ducts are evenly distributed at the outer side of the foundation pile in about the same plane, whereby beads are formed around foundation piles at different depths by injection of material through the internal longitudinal cavity in the foundation pile and the filling ducts. This implies that the foundation pile is imparted increased tensile strength, and that the foundation pile is secured against lateral movement irrespectively of which direction tensile forces are acting on the foundation pile.

The material which is pumped/pressed down into the surrounding earth layer for formation of beads or footing element, can be a cement mixture, concrete, grout, slurry or a setting plastic material. The most important property of the material is, however, that it reacts with or binds to the tension members, the pile foot and/or the lower part of the foundation pile and possibly the side of the foundation pile. When this filler has been hardened, it will thus be bonded securely to the foundation pile.

In order to achieve an even better bond between filler and foundation pile, the surface of individual parts of the foundation pile may be designed with an uneven surface as for example grooves or small projections. This enhanced contact will in turn assist in increasing the tensile strength of the foundation pile.

In an embodiment of the invention, the uppermost filling ducts will be placed so that the upper bead will be formed at a depth of about 2 meters, where this bead cannot contribute to the absorbing of compressive and tensile forces by the foundation pile, but instead will contribute to stabilizing the foundation pile against lateral movements, which can be a problem by erecting foundation piles in soft ground, as for example loose sand.

For increasing the strength of the foundation pile and possibly reducing the dimension of the foundation pile, it may be designed with one or more external reinforcements.

These reinforcements can be produced during formation of the foundation pile itself, or by subsequent mounting before placing the foundation pile and will contribute to increasing the resistance of the foundation pile against lateral movements and breakage during placing the foundation pile.

In order to perform rapid and easy mounting of the foundation piles for the foundation, the at least one throughgoing longitudinal cavity of the foundation pile may be designed with a screw thread at the upper part so that a bolt rod, bolt or screw/nut may be used for fastening the foundation piles to the foundation.

In water-carrying earth, as for example sand layers, it may be difficult to form a cavity under the foundation pile. For stabilizing this earth/sand layer, a number of holes may be provided in the sides of the foundation pile at the lower part of the foundation pile. These holes are used for pressing a hardening filler out into the surrounding earth layer, which will stabilize the earth when the filler is hardened, so that it is possible to form a cavity around the lower part of the foundation pile without undesired material/liquid falling down into the cavity due the porous condition of this earth layer or due to the water pressure in this earth layer.

Another possibility is to pressurize the cavity so that the water in the earth/sand layer is kept away from the cavity while the reinforcement unit is pressed down through the foundation pile and casting of the footing element, and that the filler, which is pressed out, is not flowing out down along the outer side of the foundation pile but is pressed out into the surrounding earth layer. Alternatively, the earth around the cavity may be frozen so that ice forms a barrier against the cavity until the footing element is cast.

In order to substitute a concrete structure in a foundation arrangement, an adapter for use in founding a tower element, preferably a mill tower, is produced, where the adapter is designed with a first mounting ring for fastening against a foundation arrangement and a second mounting ring for fastening against the tower element, where the first and the second mounting rings are connected with one or more connecting elements.

The adapter is placed as a transition element against the lower part of the tower element and the foundation arrangement, which means that the two mounting rings of the adapter are to fit in dimension with the corresponding mounting parts of the lower part of the tower element and the foundation arrangement. Therefore, the relation between the outer circumference of the first mounting ring and the outer circumference of the second mounting ring may be one or more of the following:

The outer circumference of the first mounting ring is largely of the same magnitude as the outer circumference of the second mounting ring, the outer circumference of the first mounting ring is less than the outer circumference of the second mounting ring, or the outer circumference of the first mounting ring is larger than the outer circumference of the second mounting ring.

A foundation for a tower element is typically to absorb two kinds of action:

A vertical load (compressive force) in the form of dead weight load from tower element and a possible further structure, for example a windmill construction, and a moment produced by the wind action on the tower element and the possible further structure. This moment is absorbed in the foundation arrangement as an evenly distributed tensile force and compressive force.

Normally, a foundation for a tower element is dimensioned for only absorbing compressive forces, whereas it is difficult for a foundation arrangement to absorb the tensile forces. By a typical construction of a foundation arrangement with a concrete structure, the tensile forces are largely absorbed by the dead weight of the foundation arrangement.

By establishing high tower elements, the tensile and compressive forces are relatively much larger compared with the size of the foundation arrangement, why it is necessary particularly to provide for absorption of the tensile forces. An advantageous solution may be to use laying pile foundation, where the foundation piles have a special design for better absorbing the relatively large tensile forces and transmit them to the surrounding earth layer.

For foundation arrangements for high tower elements, or for tower elements erected on soft earth, laying pile foundation under the entire foundation arrangement has typically been applied for attaining uniform carrying capacity for the whole foundation arrangement with regard to the compressive forces. This method has not been optimal in relation to the carrying capacity with regard to the tensile forces as the foundation piles situated closest to other center of the tower element did not have sufficient spacing from the vertical center plane for the tower element in order to absorb the tensile forces for which they are dimensioned. By laying pile foundation in that way, this has caused an unnecessary large number of foundation piles for absorbing the forces, in particular tensile forces, to be used.

According to the invention, this number can be reduced by using the described adapter in connection with specially designed foundation piles, where a number of foundation piles are situated so that they have a suitable distance to the center of the tower element, whereby they are utilized optimally, absorbing the tensile forces for which they are dimensioned. This is a great advantage as a foundation pile, including transportation, placing in the ground, and fastening to the adapter, is assessed to cost DKK 4000–8000, and each foundation pile is expected to be 15–30 m long.

In order to optimally distribute the tensile and compressive forces caused by the dead weight and wind action on the tower element, it is advantageous if the adapter is designed so that the outer circumference of the first mounting ring of the adapter is larger than the outer circumference of the second mounting ring.

In order to achieve an even distribution of tensile and compressive forces around the adapter, it may be designed so that the first mounting ring is designed with at least two holes for fastening the adapter against the foundation arrangement, where the at least two holes are evenly distributed around the first mounting ring. The distribution of holes around the first mounting ring provides for transmission of tensile and compressive forces may effected optimally, irrespectively how the wind is acting on the tower element. The holes, which may be provided with internal thread, provides that mounting of the adapter against the foundation arrangement with bolt and/or nut joints may be performed, which is a secure and easy method compared with e.g. in situ welding. In a preferred embodiment of the adapter, there will be between 20 and 30 holes around the first mounting ring.

In order to build up the adapter of a material of lesser dimension simultaneously with the obligatory compressive and tensile forces transmitted from the tower element to the foundation arrangement being absorbed, the adapter is designed so that the first mounting ring and at least one connection element are connected with one or more reinforcement elements. These reinforcement elements may, for static reasons be placed either evenly distributed around the first mounting ring by using a continuous connecting member, or distributed in connection with a number of discontinuous connecting members, or at a certain position estimated from statistical calculations to absorb the exertion of force occurring at a certain position for a very large part of the time, for example in areas with one particularly prevailing wind direction whereby unilateral action on the tower element occurs.

In a preferred embodiment of the adapter, there are an even number of holes and reinforcement members which are evenly distributed around the first mounting ring, which is connected with a continuous connecting member. The disposition of holes and reinforcement members is made so that a reinforcement member is placed at the same distance between two holes on the same ring and so that there is space for mounting/dismounting bolt and/or nut.

In order to achieve even distribution of tensile and compressive forces around the adapter, it can be designed so that the second mounting ring is designed with at least two hole for fastening the adapter against the tower element where the at least two holes are evenly distributed around the second mounting ring. The distribution of holes around the second mounting ring provides for optimal transmission of tensile and compressive force irrespectively of how the wind is acting on the tower element. The holes, which may be provided with internal thread, provide for mounting of the adapter against the lower part of the tower element with bolt and/or nut joints, which is a secure and easy method compared with for example welding on site.

In a preferred embodiment of the adapter, there will be between 15 and 30 holes around on the second mounting ring. The number of holes in the second mounting ring does not necessarily correspond to the number of holes in the first mounting ring but is determined by the dimension of bolts/nut assembly and the space needed for mounting/dismounting these.

In a further preferred, alternative embodiment of the invention, the adapter may be designed so that the fastening of the adapter against the foundation arrangement is effected with bolts and/or nuts, and that the adapter is either an integrated part of the lower part of the tower element or is fastened to the tower element by welding. This provides possibility of making and transporting the adapter together with the tower element whereby adaptation and mounting of adapter against the tower element on site is avoided.

The adapter is constructed of continuous connecting elements/discontinuous connecting elements and two mounting rings, where the first and the second mounting rings may be designed according to one or more of the following combinations:

- the first and second mounting rings are annular,
- the first mounting ring is a plate and the second mounting ring is annular,
- the first mounting ring is annular and the second mounting ring is a plate, or
- the first and the second mounting rings are plates.

By mounting an adapter made with a continuous connecting member, and where the first and second mounting rings are plates (a closed adapter), access for mounting the adapter against the foundation arrangement and the lower part of the tower element may be achieved via a manhole, either in the plate of the second mounting ring or in the connecting member.

An advantage of the adapter being designed as a closed element may be to protect bolts/nuts against corroding surroundings, as for example sea water.

In order to adapt the adapter to different types of tower elements and foundation arrangements, the adapter is designed according to one of the following geometrical shapes: a truncated cone, a frustum of a pyramid, a prismatoid, or an obelisk.

By using the adapter as substitution of a concrete structure for a small or middle-size windmill, it may be a production advantage that the adapter has the shape as either a frustum of a pyramid, a prismatoid, or an obelisk, as these shapes are simple to produce and assemble, implying reduced price.

In a preferred embodiment of the invention, the adapter is designed so that the entire outer circumference of the second mounting ring is connected with a continuous connecting element to the entire outer circumference of the underlying first mounting ring, and that both mounting rings are annular. This embodiment enables reducing the dimension of the material of the continuous connecting element, and to establish a large number of reinforcing members that may be disposed evenly distributed around the first mounting ring, and furthermore a natural transition arises between the lower part of the tower element and the foundation arrangement.

It is furthermore the purpose of the invention to indicate a method for using the adapter by laying foundation to a tower element.

In order to utilize the described adapter by laying foundation to a tower element, it is necessary with the following method:

- A foundation arrangement is placed upon and/or in the ground,
- the adapter is placed directly upon the foundation arrangement and is fastened to it, and
- the tower element is placed upon the adapter and fastened to it.

Furthermore, the foundation arrangement can include at least one foundation pile which is disposed in the ground spaced apart from the center of the foundation arrangement and at an angle of 0–90 degrees, preferably 0–45 degrees, from a vertical plane.

Disposition of the foundation piles at an angle from a vertical plane will imply greater carrying capacity of the foundation arrangement, as the amount of earth lying around the foundation pile contributes to increasing the carrying capacity of the foundation arrangement against tensile forces. When the foundation piles are standing too close to each other, they are pulling in the same earth mass. However, by angling the piles away from each other, each foundation pile pulls/presses in more earth mass. However, it is advantageous to keep the angle in the area 0–45 degrees from a vertical plane as the carrying capacity of the foundation arrangement for compressive forces is considerably reduced by placing foundation piles at angles more than 45 degrees from a vertical plane.

For placing a foundation pile and to perform reinforcement of a footing element with a reinforcement unit, the method includes the following steps:

- the foundation pile is placed in desired position, either by pressing or driving down or by placing in pre-drilled holes,
- a folded reinforcement unit is pressed down through the at least one through-going longitudinal cavity in the foundation pile,
- when the reinforcement unit reaches the bottom of the foundation pile, it is pressed a distance farther down, and the means for expanding the reinforcement members are activated, thereby forming a network at least the reinforcement members, curable filler is pressed down through the at least one through-going longitudinal cavity in the foundation pile, so that the lower part of the foundation pile and the expanded reinforcement unit are cast in one for formation of a reinforced footing element with larger dimension than the outer dimension of the foundation pile.

With this method is achieved that the foundation pile becomes usable in relation to both compressive and tensile forces caused by the construction to which the foundation pile is connected, and that the reinforcement unit is placed in the desired position and is expanded so that it forms an evenly distributed reinforcement in the footing element, whereby the footing element may increase the strength of the foundation pile against compressive forces caused by for example wind action.

Selection of method for placing by either pressing down, driving down or by placing in pre-drilled holes, is determined by which type of soil the foundation pile is to be placed. In very soft soil, and in areas where vibrations are not to occur, either pressing down or placing in pre-drilled holes will be the case. In areas where the earth is hard, and where there is substantial distance to the nearest other building constructions, driving of the foundation pile may be applied. By driving the foundation pile it is, however, to be ensured that the foundation pile is made of a material which has the necessary strength for resisting the repeated blows, or is designed with the needed external reinforcements.

It is important that the reinforcement unit is not placed with a large part of the upper part of the reinforcement unit in the foundation pile, and that the reinforcement unit, when reaching the bottom of the foundation pile, is pressed a distance farther down so that the expansion of the reinforcement unit may occur without the lower part of the foundation pile preventing complete expansion of the foundation unit in the underlying cavity.

By pressing out filler in the interspace between the reinforcement unit and the bottom of the foundation pile, the tension members are cast which, together with the reinforcement members, provide that the footing element attains greater strength against the tensile and compressive force to which it is exposed.

In an embodiment of the invention, where the reinforcement unit includes pipes for the tension members, the pipes are cast into the footing element which, together with the reinforcement members which will provide that footing element/foundation pile attains greater strength against the compressive and tensile forces to which it is exposed.

In order to ensure that the reinforcement unit is in the correct depth, the above method may be added a further step as follows: After placing the foundation pile, the pile foot is pressed and/or driven farther down into the ground with a piston and/or a driving tool, where the distance between the pile foot and a lower part of the foundation foot at the most corresponds to the length of the free part of the tension members.

For driving the reinforcement unit of the foundation pile farther down into the ground, a piston or a driving tool may for example be used, where the piston may be driven by hydraulic, pneumatics, or an electric motor which presses on the reinforcement unit at a steady pace until the tension members are extended and the reinforcement members are expanded.

Alternatively, in cases where the tension members are constituted by rods, the reinforcement unit with a pile foot may be pressed down into the underlying earth layer at an arbitrary depth, however with the purpose that filler can be pressed out in such an amount that it may hold the pile foot and the bottom of the foundation pile and simultaneously form a footing element with greater dimension than the outer dimension of the foundation pile. If the distance between the pile foot and the foundation pile becomes too great, it will be almost technically impossible to press out so large a mass that these two can be connected.

The method mentioned initially may, depending on soil conditions, have added a further step, where, before pressing down the folded reinforcement unit, there is formed a cavity under the lower part of the foundation pile with a soil preparation unit.

This soil preparation unit may furthermore be used for, for example, removing the material pressed/driven up in the foundation pile during the driving down of this. The soil preparation unit may for example be a mechanical drilling unit, a sand blowing unit, a compressed air unit, a high pressure cleaning unit, or similar units that may be passed down through the foundation pile and remove the unwanted material, either inside the foundation pile or below the lower part of the foundation pile.

The choice of type of soil preparation unit depends on the soil conditions, as the different types of units may be used for different types of soil. For example, in soil with much sand it will be optimal to flush out the sand by for example a high pressure cleaning unit.

If there is formed a cavity under the lower part of the foundation pile with a soil preparation unit, the following steps may be inserted in the method mentioned at first:

when the reinforcement unit reaches the bottom of the foundation pile, it is pressed down into the underlying cavity until the retainer elements at the upper part of the reinforcement unit fall in place out against the inner side of the foundation pile, and where subsequently the reinforcement members are pulled so that it is ensured that the reinforcement unit and the bottom of the foundation pile are in close connection.

By adding these steps to the method, it is ensured that the reinforcement unit is placed in immediate vicinity of the lower part of the foundation pile so that the lower part of the foundation pile and the reinforcement unit are cast together.

The retainer elements further provide that the lower annular part of the foundation pile does not destroy the filler when it is subjected to compressive forces from the foundation, as the weight causing the compressive forces are transmitted from the foundation pile to the footing element via the retainer surfaces of the retainer elements which combined have a greater area than the cross-sectional area of the lower part of the tubular foundation pile.

In order to expand the reinforcement members out into the cavity for optimal reinforcement of the footing element, to the initially mentioned method is added one of the following steps, where the means for expanding the reinforcement members are:

a spring ring, whereby the pipes are pressed outwards, and the reinforcement member will thereby, via the eye connection, be forced outwards, so that a network of pipes, reinforcement members and the centrally arranged annular element is formed, a spreading element is arranged so that it controls the reinforcement members of the reinforcement unit when they are falling outwards due to the force of gravity when the reinforcement unit reaches the cavity under the foundation pole, so that a network of reinforcement members and the centrally arranged annular element is formed, an exploding unit whereby the reinforcement are pressed outwards as a result of the explosion.

All of the three described steps for expansion of the reinforcement member result in that the reinforcement in the cast footing element is spread as much as possible in the footing element, and thereby the strength of the footing element is increased.

The spreading element is an element which, besides spreading the reinforcement members, further provides for the reinforcement member being secured at a certain position out from the foundation pile until they are cast into the footing element. The spreading element may be activated by being pressed on by a piston passed down through the longitudinal cavity in the foundation pile.

By using a reinforcement unit with pile foot, expansion of the reinforcement members occurs when a piston is pressed down on the annular element of the reinforcement unit, after which the reinforcement members are passed through the mounted connection between pipe and reinforcement member, and whereby the reinforcement members are pressed outwards.

For forming a cavity in connection with lower part of the preferably cylindric foundation pile, the initially mentioned method may be added the following step:

- a ground preparation unit is passed down through the working duct,
- the ground preparation unit works the surrounding earth layer under the foundation pile, a cavity is formed out from the foundation pile,
- the ground preparation unit is drawn up through the working duct.

The ground preparation unit may be one of many possible units that may be pressed down through the longitudinal cavity in the foundation pile and form a cavity in the surrounding ground area. It may for example be a mechanical drilling unit which, when pressed down through the longitudinal cavity in the foundation pile, is folded and which, when reaching the bottom of the foundation pile, will unfold and drill the surrounding earth layer to a certain diameter out from the foundation pile.

Alternatively, the ground preparation unit may be an explosion apparatus which is pressed down through the longitudinal cavity in the foundation pile and placed in the interspace between the foot pile and the foundation pile, after which the explosion arrangement is brought to detonation. A cavity is created with the aid of the pressure of the explosion. This method is, however, to be used with care, as it may damage the tension members, the pile foot and the bottom of the foundation pile.

Alternatively, high pressure flushing may be used, where a high pressure flusher is passed down through the longitudinal cavity in the foundation pile and down to the interspace, which is flushed out, and where excess water and soil is pumped up through the working duct. Thereby a cavity remains which can be filled up with filler embedding the said parts.

Alternatively, depending on special types of soil, it may be unnecessary to use a soil preparation unit. Instead, it may be possible to perform injection of filler through a long tube which is passed down internally in the tubular foundation pile. This method is best used in very soft ground.

Alternatively, it may also be considered that during driving down of the foundation pile, a pile foot has be used, protecting the foundation pile against material that would be driven up inside the foundation pile during the driving down of the latter.

In order to increase the tensile and compressive strength of the foundation pile and to minimize the risk of lateral movements of the foundation pile, the above method may be added a further step where injection of a hardening filler mass through the at least one longitudinal cavity and out through the filling ducts connected therewith is effected for forming one or more beads around the outer circumference of the foundation pile.

This step is performed right after placing the foundation pile in the desired position, or may be performed at a later time in the lifetime of the foundation pile. Hereby, for example crookedness in the foundation pile or inaccuracies in the position of the foundation pile may be corrected, and it may be ensured that arised lateral inaccuracies are corrected.

These filling ducts may furthermore be used for removing the foundation pile after the lifetime of the building element has ended, where today there are requirements to removing building material as far down in the ground as possible. These filling ducts may then be used for pressing out or spraying out agents that either can dissolve a cement mix or lubricate the outer side of the foundation pile so that it is easy to pull it up.

By pulling up there may, however, appear a problem with the footing element itself. Therefore, it may be a solution to cut the tension members. It is possible to pull the foundation pile up, leaving pile foot and footing element in the ground, if the tension members are provided in a side duct without fixed castings.

If the footing element is fastened to the bottom of the foundation pile, longitudinal cavities in the foundation pile may be used for sending down an explosion apparatus which is placed right at the top of the footing element, so that the footing element by detonation will burst/separate from the foundation pile. This enables pulling up the foundation pile.

By making foundation piles with side ducts through which the tension members may have free, longitudinal movement, the foundation pile may be built up of modules so that it is easier to transport and produce. This means that at the place where the pile is to be produced or driven down, there may be added one module after the other, when only the tension members are passed through the side ducts on the succeeding module. This provides for placing foundation piles in areas where one is not so sure of the depth of the bottom part of the foundation pile. However, this requires than the tension members present such a length that, irrespectively of the depth, a part will project up over the upper edge of the foundation pile.

In order to prevent dilution of the filler injected at the formation of the footing element, injection of a liquid barrier filler material into the cavity under the foundation pile before placing the reinforcement unit and casting of the footing element may be performed. This has the consequence that water in the earth layer is kept away until the filler is hardened. The liquid barrier filler material can be a mix of for example gelatine, cement paste or similar material that may be displaced by the filler injected when the footing element is cast. Alternatively, the soil may be frozen.

BRIEF DESCRIPTION OF THE DRAWINGS

The invention is explained in the following with reference to the accompanying Figures, where.

DETAILED DESCRIPTION OF THE INVENTION

Figures 1A, 1B, 1C:
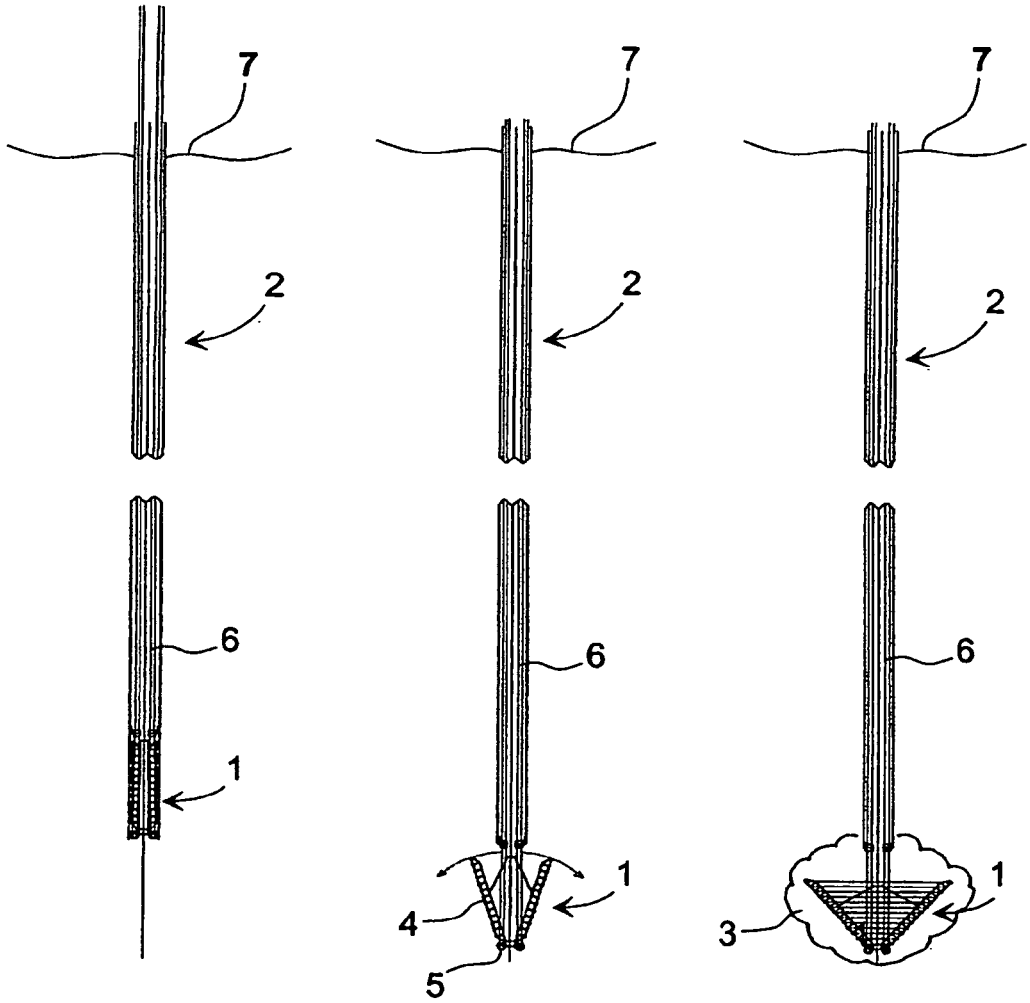
FIG. 1*a* shows a foundation pile with a reinforcement unit.
FIG. 1*b* shows a foundation pile with a reinforcement unit.
FIG. 1*c* shows a foundation pile with a reinforcement unit.

On FIGS. 1*a*, 1*b* and 1*c* is shown how a reinforcement unit 1 is pressed down through a foundation pile 2 and unfolded in an underlying cavity 3.

The reinforcement unit 1 includes reinforcement members 4 which are pivotably connected to a centrally arranged annular element 5 and are connected to the foundation pile 2 with tension members 6.

The foundation pile 2 is placed in the ground so that the upper edge of foundation pile 2 projects up over the ground surface 7.

Figure 2:
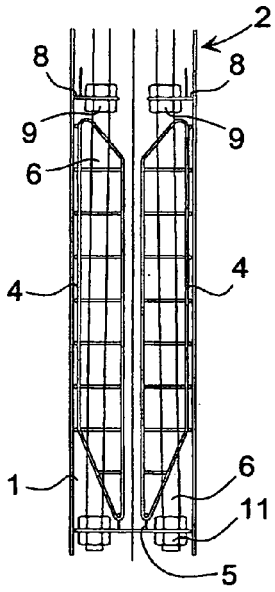
FIG. 2 shows a folded reinforcement unit.

FIG. 2 shows a reinforcement unit 1 which is disposed in folded position in a lower part of foundation pile 2. The reinforcement members 4 are pivotably connected to a centrally arranged annular element 5 which is connected with the tension members 6 via a plate/bolt joint 11.

The lower and upper parts of the tension members 6 are joined in a jointing arrangement 9 shown here as a plate/bolt joint. The jointing arrangement 9 is provided with retainer elements 8.

Figure 3:
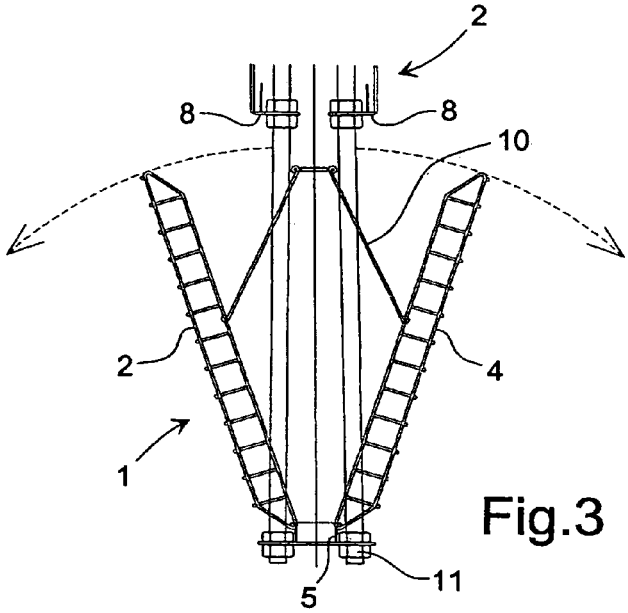
FIG. 3 shows a reinforcement unit about to be spread.

FIG. 3 shows a reinforcement unit 1 placed right under the lower edge of foundation pile 2 and in a position where the reinforcement unit 1 is about to unfold.

The reinforcement members 4 are made of a network of rods and connected with a spreading element 10 providing that the reinforcement members 4 unfold uniformly and to a certain angle.

Figure 4:
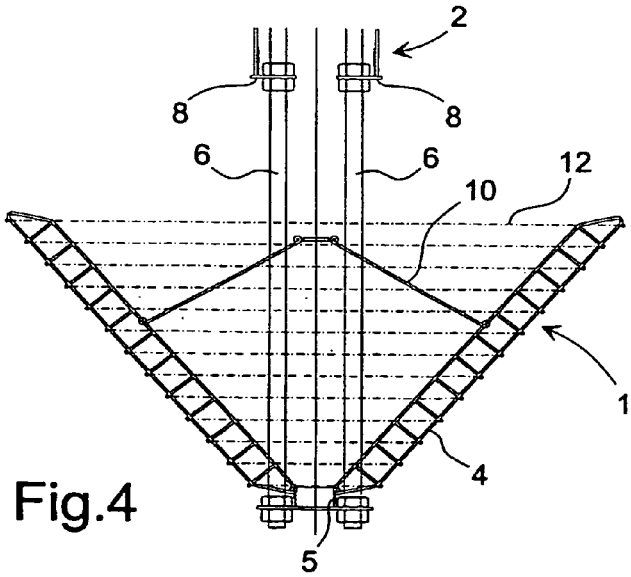
FIG. 4 shows an unfolded reinforcement unit.

FIG. 4 shows a reinforcement unit 1 in fully extended position. The spreading member 10 holds the reinforcement members 4 in place until the footing element (not shown) has been cast.

The retainer elements 8 have fallen in place so that they abut on the lower edge of the foundation pile 2.

A number of wires 12 connect the reinforcement members mutually in order thereby to achieve additional reinforcement of the footing element (not shown).

On the three FIGS. 2–4 are shown how the reinforcement members 4 are pivoting about the annular element 5 when the reinforcement unit 1 is unfolded.

Figure 5:
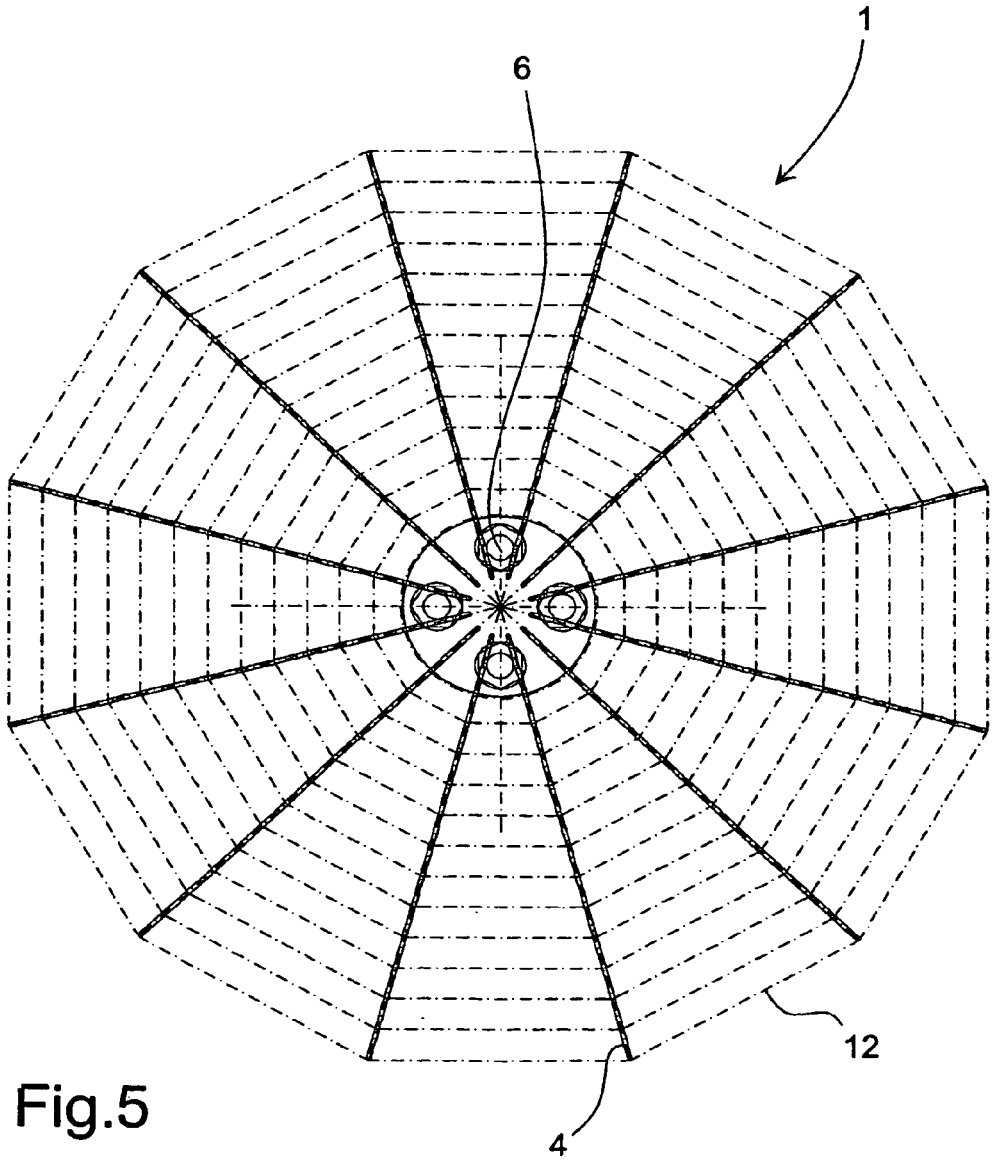
FIG. 5 shows a plan view of a reinforcement unit.

FIG. 5 shows a plan view of an unfolded reinforcement unit 1 where the reinforcement members 4 are connected with a wire 12 whereby is formed a pattern like a spider's web of reinforcement in the footing member (not shown).

Figure 6:
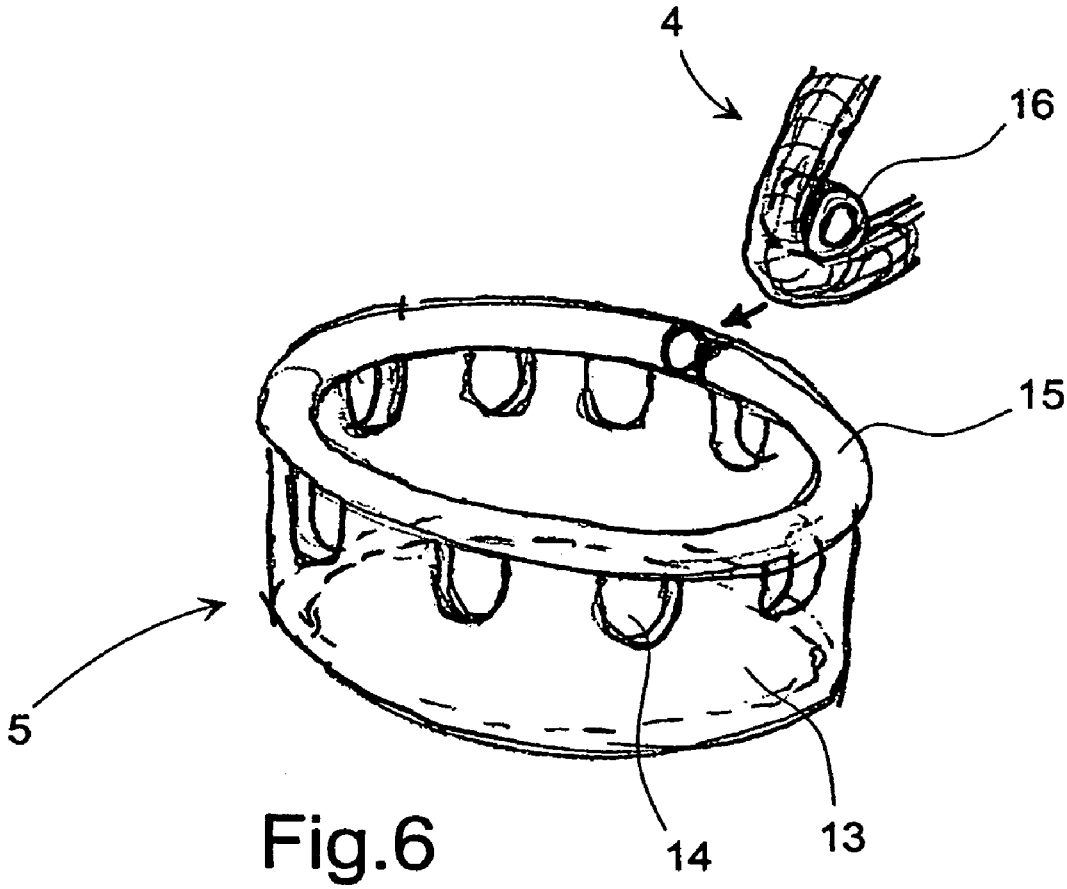
FIG. 6 shows an annular element according to the invention.

FIG. 6 shows an annular element 5 with upright circular side 13 in which there is a number of recesses 14 and an edge ring 15. The number of recesses 14 in the upright circular side 13 corresponds to the number of reinforcement members 4.

In an end part of the reinforcement members 4 there is provided a bearing 16, the inner diameter of which corresponding to the outer diameter of the edge ring 15 so that it is possible to mount the reinforcement members 14 to the edge ring 15. The recesses 14 enable the reinforcement members 4 to pivot about the edge ring 15.

Figure 7B:
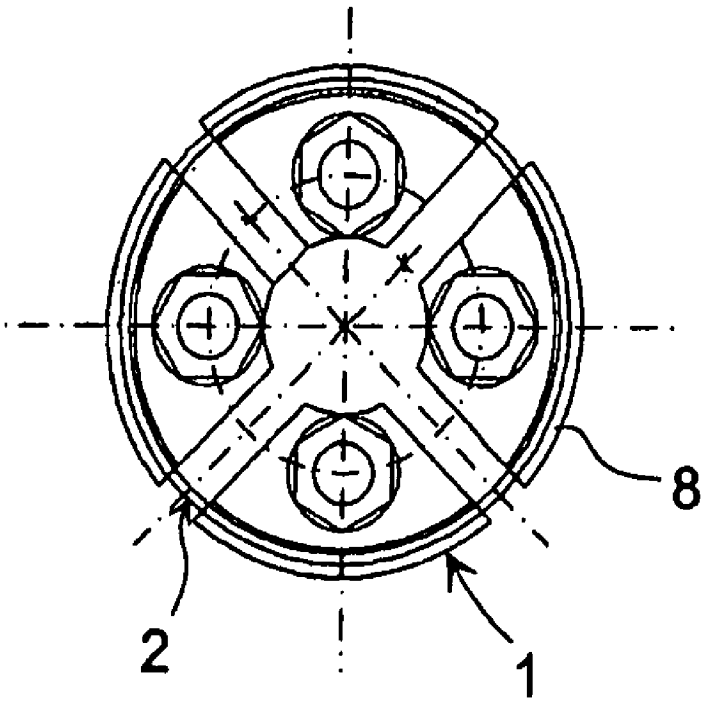
FIG. 7*b* shows a cross-section in a foundation pile with an unfolded reinforcement unit.
Figure 7A:
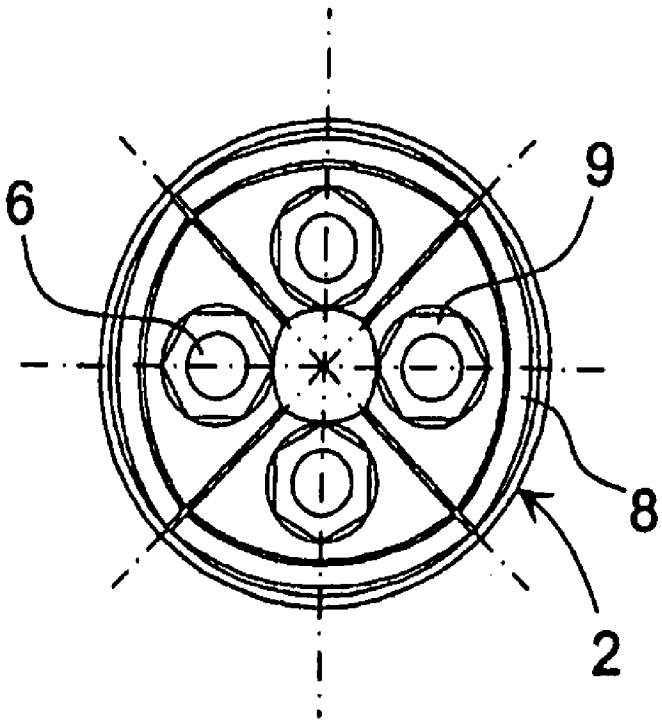
FIG. 7*a* shows a cross-section in a foundation pile with a folded reinforcement unit.

FIG. 7*a* shows a sectional view of how a reinforcement unit 1 is disposed inside a foundation pile 2. The jointing arrangement 9 is a plate/bolt joint where the plate section is divided into four and continues in retainer element 8.

FIG. 7*b* shows a sectional view of an expanded reinforcement unit 1 where the retainer elements 8 abut on the lower edge of foundation pile 2.

Figure 8:
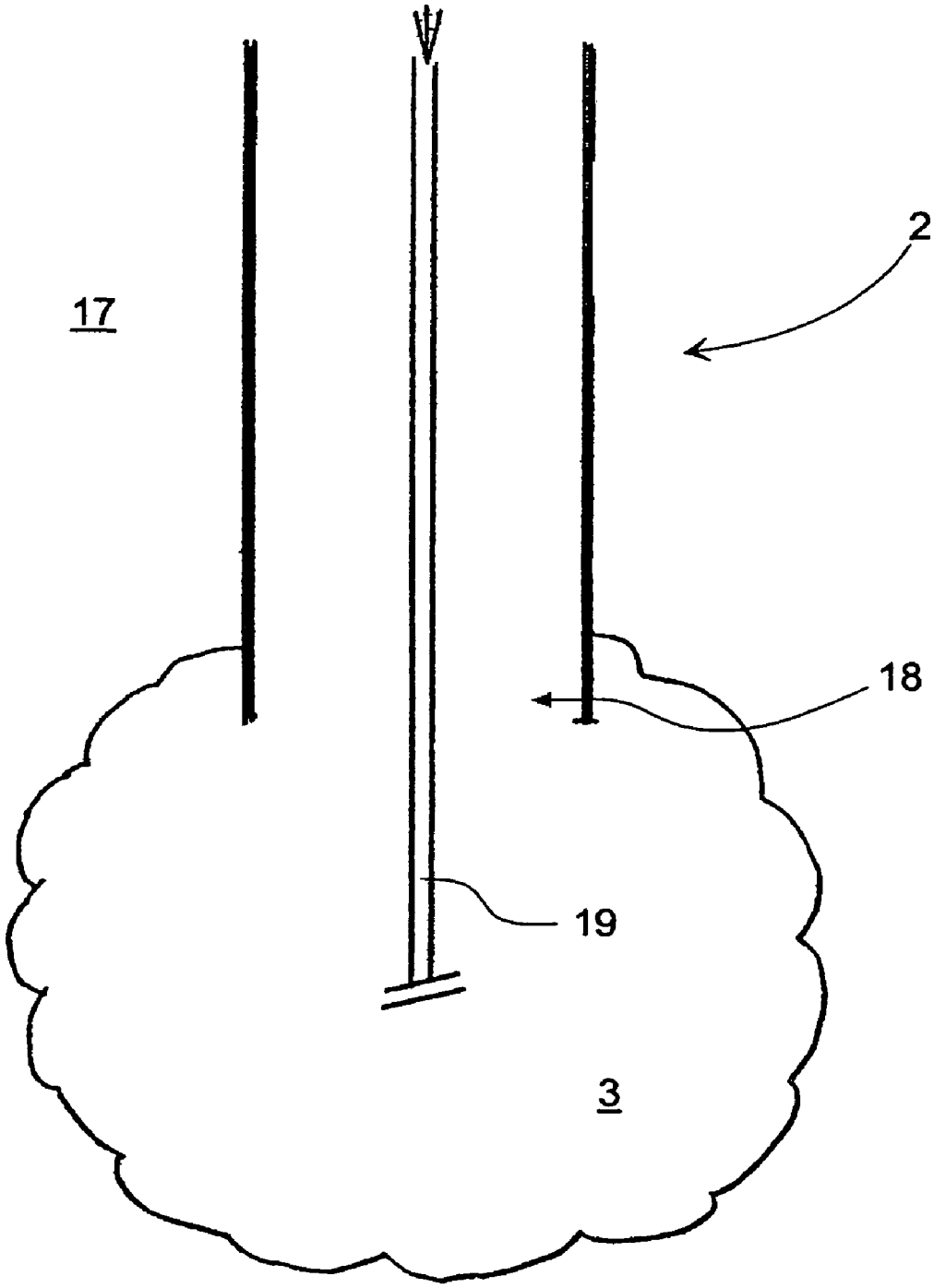
FIG. 8 shows the lower part of a foundation pile disposed in the ground, and where formation of a cavity under the foundation pile occurs.

FIG. 8 shows a foundation pile 2 which is placed in the ground 17 where in connection with the lower part 18 of foundation pile 2 there is produced a cavity 3 under the lower part 18 of the foundation pile 2. The cavity 3 is formed by a pipe 19 being passed down through the foundation pile 2, and liquid or air or similar being injected through the pipe 19 so that excess material is pressed up into the interspace between pipe 19 and inner side of foundation pile 2.

Alternatively, the excess material may be absorbed depending on the pressure applied on the foundation pile 2 and the length of the foundation pile 2. A combination between suction and pressure may furthermore be envisaged applied for removing excess material from cavity 3.

Figure 9:
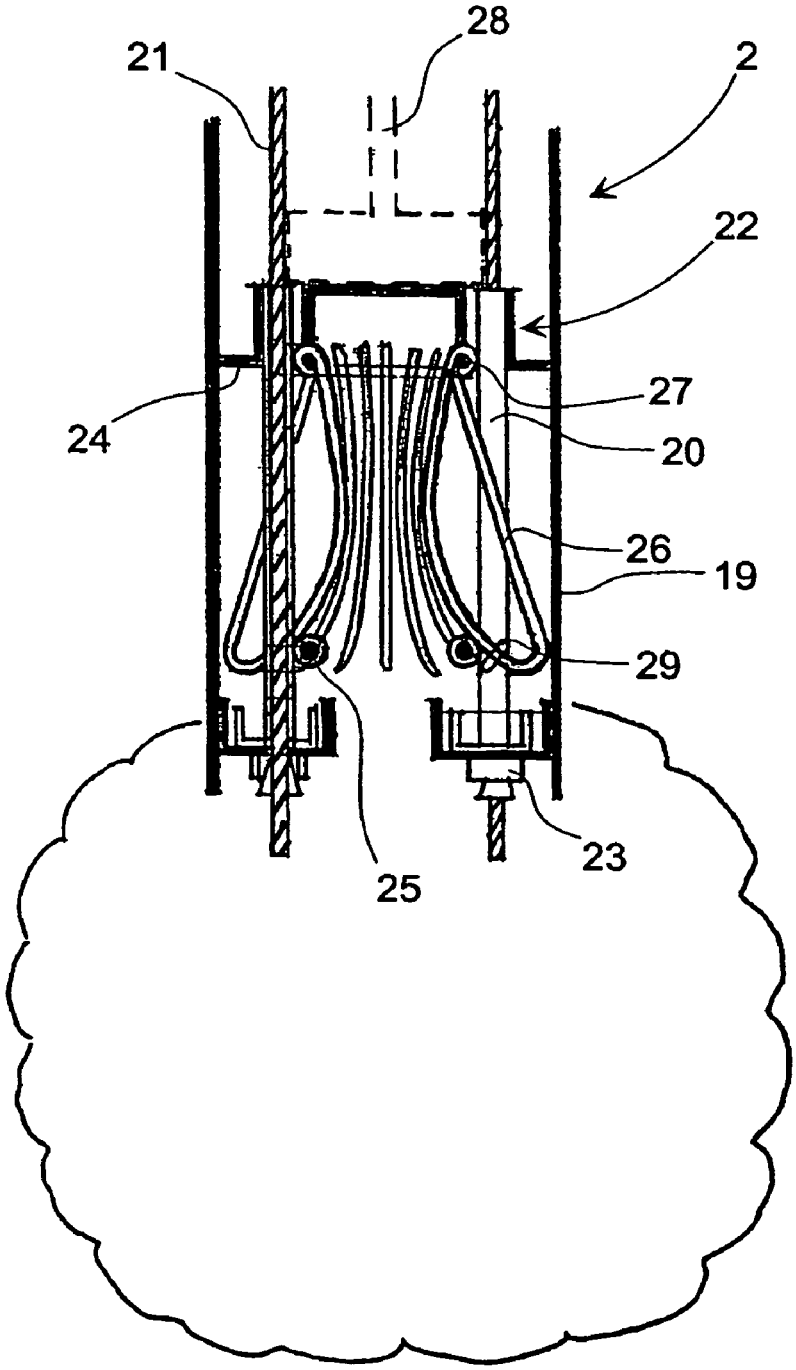
FIG. 9 shows the lower part of a foundation pile in which there is placed a reinforcement unit according to the invention.

FIG. 9 shows a lower part 18 of the a foundation pile 2 in which there is placed an alternative reinforcement unit 22 where this reinforcement unit 22 includes a number of pipes 20 through each of which pipes 20 there is provided a wire 21 connected to the lower part of pipe 20 by means of a wire clamp 23. In the upper part of the pipes 20 there are provided retainer members 24 shown here with a cross-sectional shape as an L.

Between the pipes 20 there is fitted a spring ring 25, here shown in compressed state; this spring ring 25 provides for the pipes 20 being held along the inner side of the foundation pile 2 so that the reinforcement members 26 and retainer elements 24 form guides for the reinforcement unit 22 down through foundation pile 2 when reinforcement unit 22 is pressed down with e.g. a piston 28.

Reinforcement unit 22 furthermore contains reinforcement members 26 that are annular, and one end is movably assembled around an annular element 27, and the reinforcement members 26 are furthermore connected movably to the pipes 20 with an eye connection 29.

Figure 10:
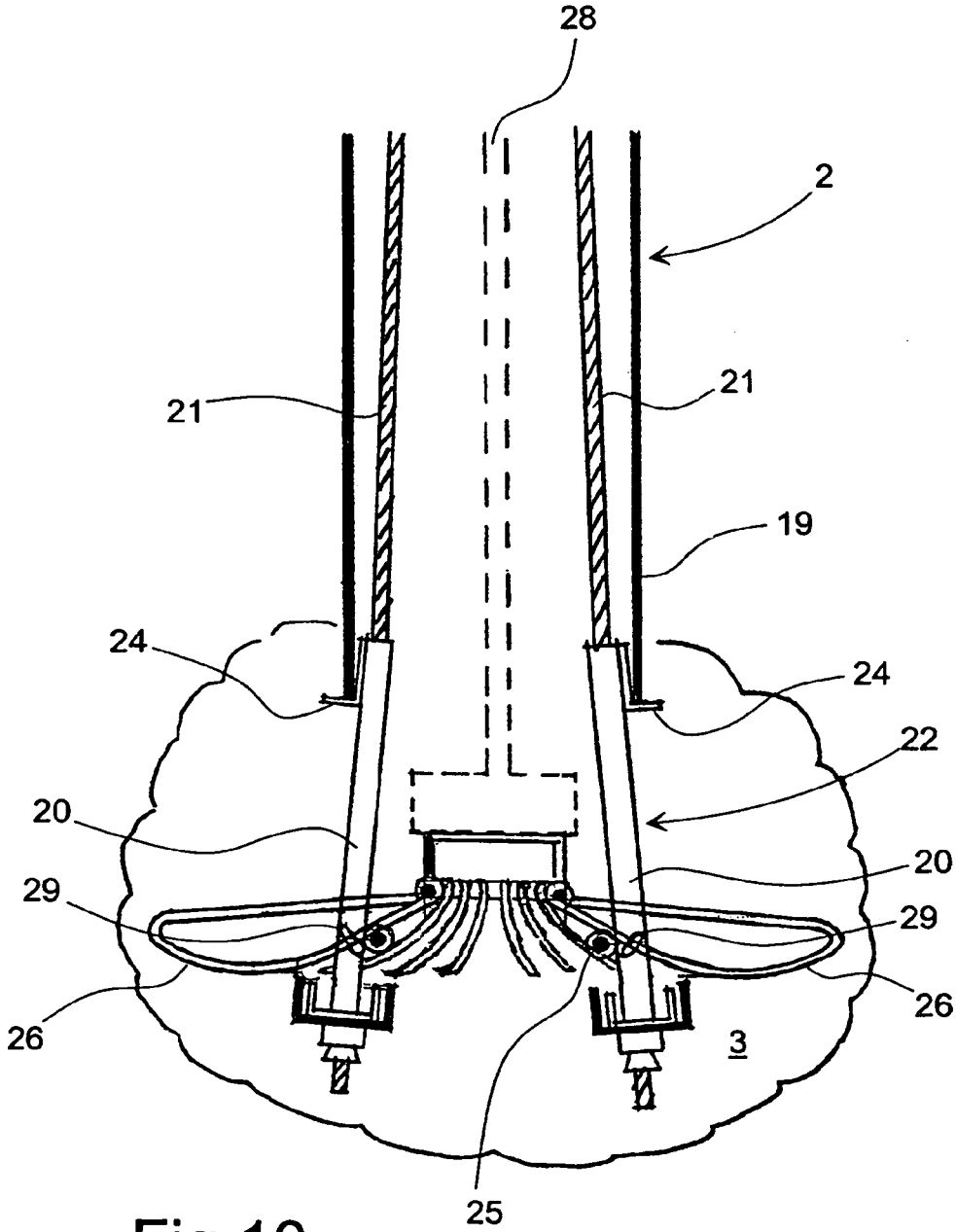
FIG. 10 shows the lower part of a foundation pile with an unfolded reinforcement unit.

FIG. 10 shows a reinforcement unit 22 that is pressed with a piston 28 down in a position under a foundation pile 2 so as to be situated in the cavity 3. Spring ring 25 is expanded and presses on the pipes 20 so that the lower part of the pipes 20 are spread outwards in relation to the center of the foundation pile 2. Spreading of the lower part of the pipes 20 results in that the reinforcement members 26 being forced out in spread position via eye connection 29 so that the reinforcement members 26 are preferably evenly distributed radially in the footing element (not shown).

In the upper part of the pipes 20, the retainer elements 24 have fallen into place, so that the lower part 19 of the foundation pile 2 abuts on the retainer element 24 when pulling in the wires 21.

Figure 11:
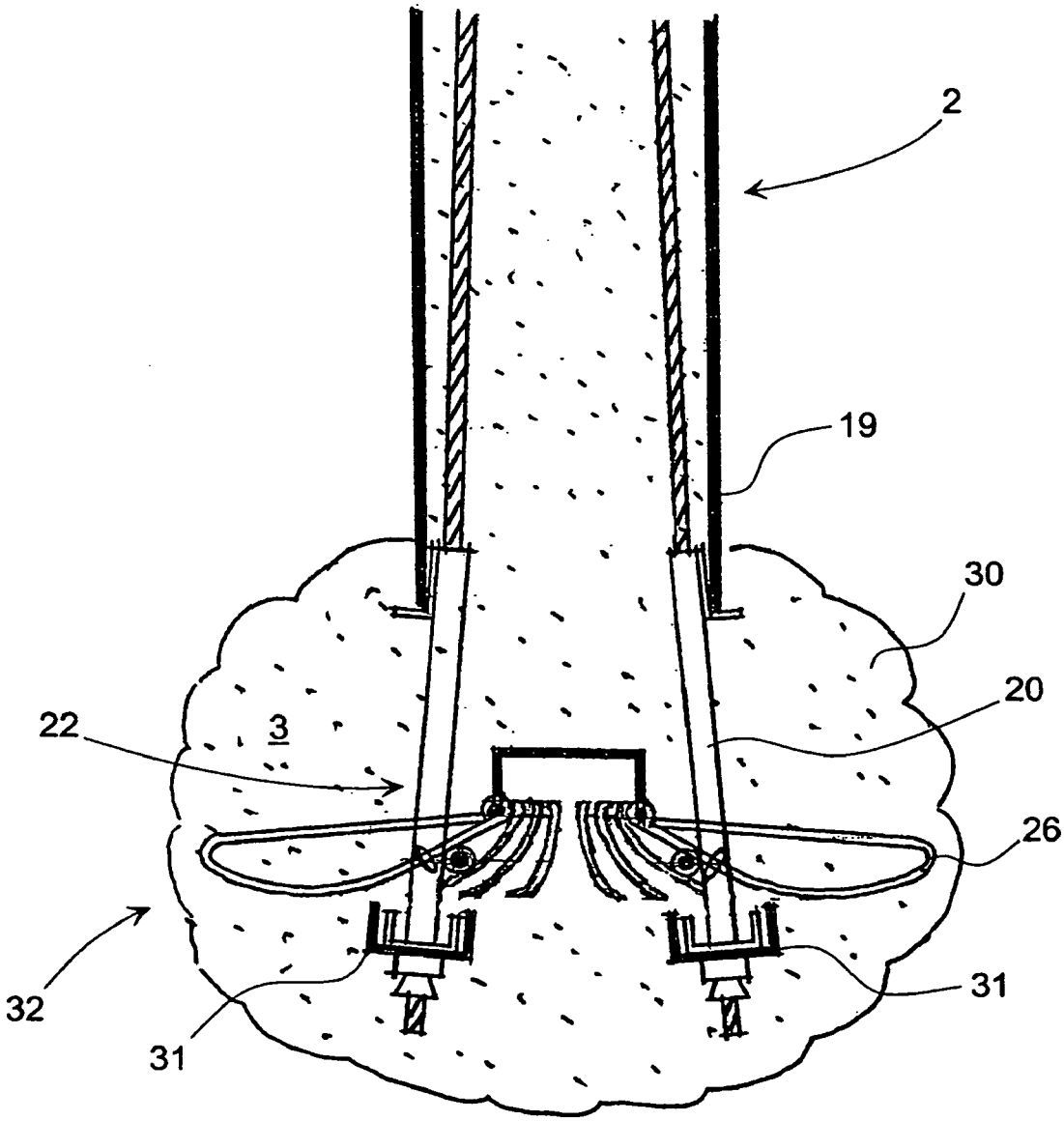
FIG. 11 shows the lower part of a foundation pile where a reinforcement unit is embedded in a footing element.

FIG. 11 shows how the piston (not shown) is removed, and a filler mass 30 fills cavity 3 and internally in foundation pile 2 so that reinforcement unit 22 including pipes 20, reinforcement members 26 and ring elements 31 are cast together with a bottom part 19 of foundation pile 2 into a footing element 32 having a dimension greater than the bottom part 19 of foundation pile 2.

Figure 12A:
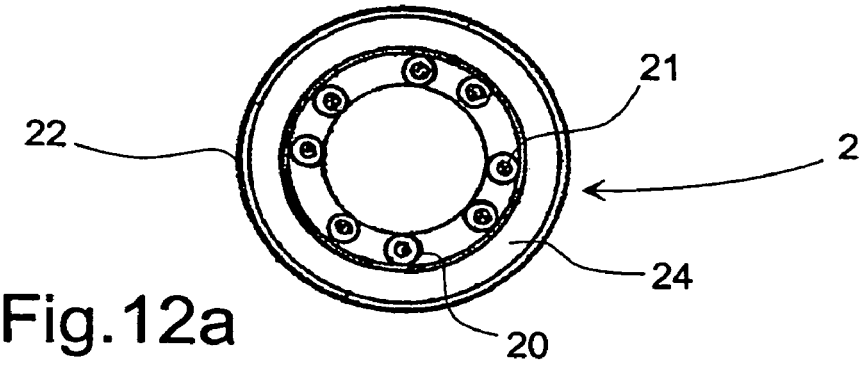
FIG. 12*a* shows cross-section of a reinforcement unit in folded position.

FIG. 12*a* shows a cross-section of foundation pile 2 in which internally there is disposed a reinforcement unit 22 including a number of pipes 20 through which wires 21 are running. It appears on the section that the outer diameter of retainer element 24 corresponds to the inner diameter of the foundation pile 2.

Figure 12B:
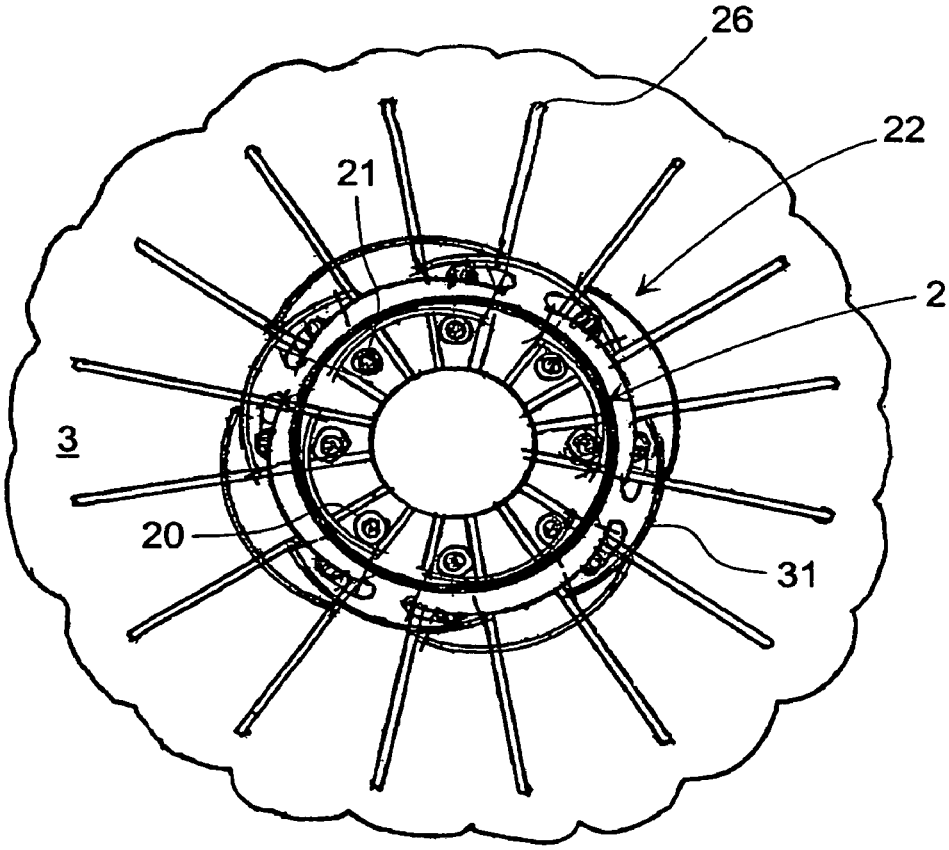
FIG. 12*b* shows a plan view of a reinforcement unit in an unfolded position.

FIG. 12*b* shows how a reinforcement unit 22 is unfolded under a lower part of a foundation pile 2. This shows how the reinforcement members 26 are spread radially out from the center of the foundation pile 2, and together with the ring elements 31, pipe 20 and wire 21, the reinforcement members 26 form a network of reinforcement which is disposed at a suitable depth under the lower part of foundation pile 2 in the cavity 3.

Figure 13:
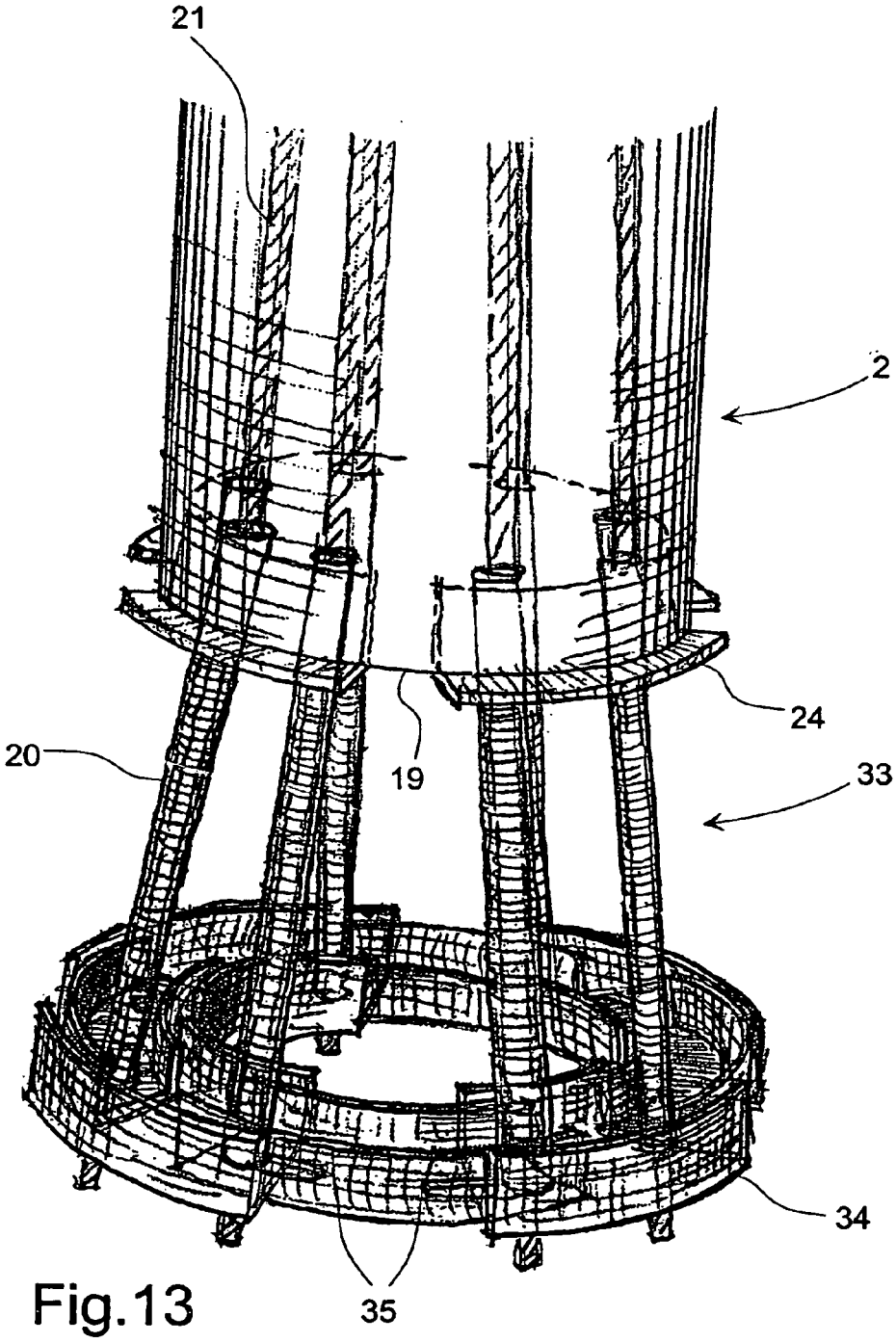
FIG. 13 shows an alternative embodiment of a reinforcement unit.

FIG. 13 shows an alternative embodiment of a reinforcement unit 33, where this reinforcement unit 33 includes a number of pipes 20 through which wires 21 are running, where these wires 21 are fastened at the lower end to pipes 20 and ring elements 34, where at the upper end of the pipe 20 there are fastened retainer elements 24 which are here connected to two pipes 20 at a time. These retainer elements 24 are here shown in L-shape which engages the lower edge 19 of foundation pile 2.

The ring elements 34 are here seen in an expanded position where they are spread most possible by means of an explosion unit (not shown). The ring elements 34 are shown in two dimensions so that juxtaposed ring elements 34 can be laid inside each other and connected by means of wire 21/pipe 20 which is passed through recesses 35.

Figure 14:
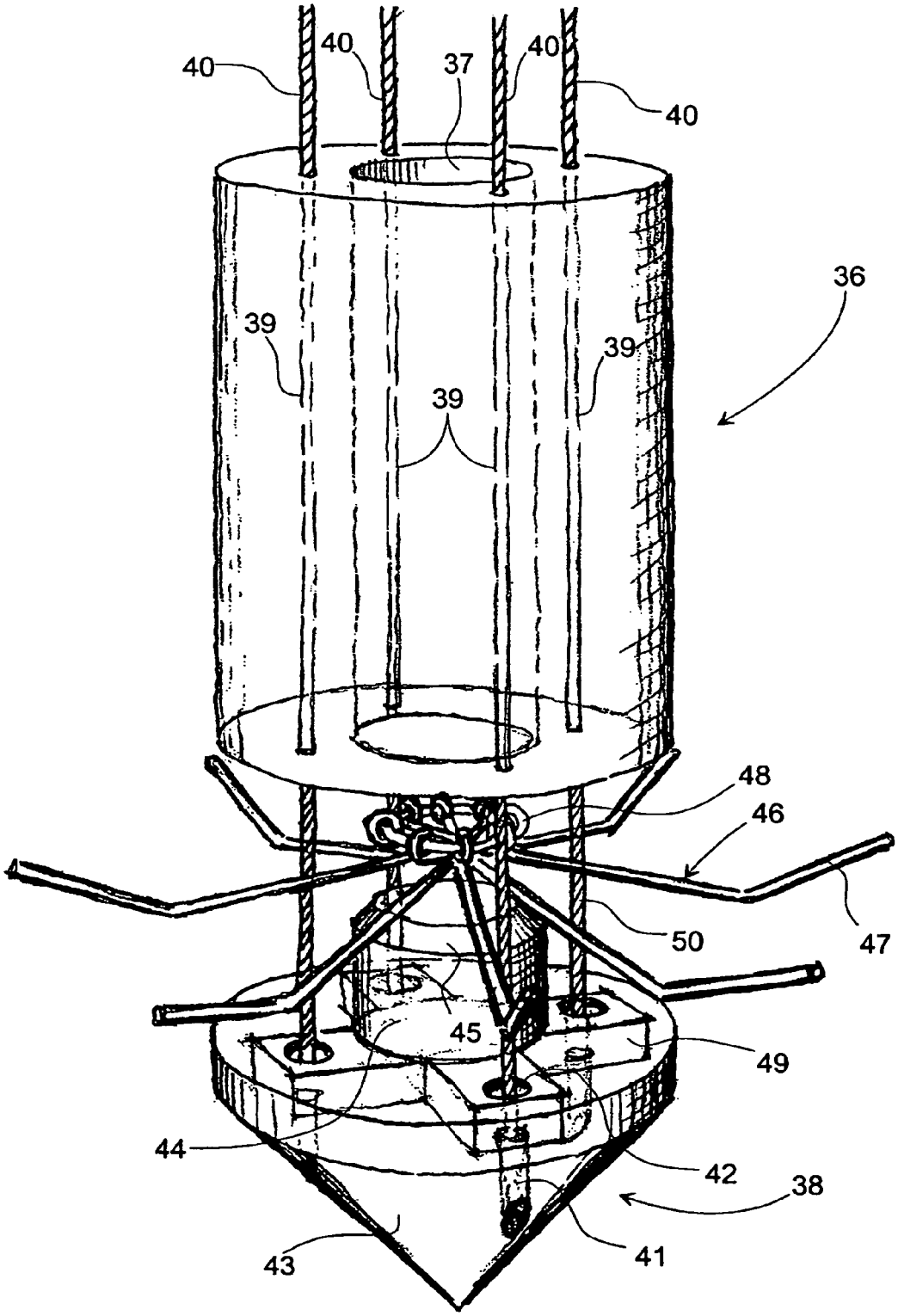
FIG. 14 shows foundation pile with pile foot and reinforcement member.

FIG. 14 shows a foundation pile 36 having an internal, through-going, longitudinal cavity 37 and a pile foot 38 where the foundation pile 36 is provided with a number of longitudinal side ducts 39, where in each side duct 39 there is disposed a tension member 40, here shown in the form of a wire.

The tension member 40 is connected to the pile foot 38 at the lower end. In the shown embodiment of the invention, the means 41 for fastening the tension members 40 to the pile foot 38 is designed as through-going ducts 42 in the pile foot 38 where the ducts 42 have one diameter at the entrance of the pile foot 38 and another, larger diameter at the underside of the pile foot 38. This provides that the tension members 40 may here be secured with for example a wire clamp (not shown).

The pile foot 38 has downwards a tapering shape 43 that enables driving the foundation pile 36 down into the ground. Upwards, the pile foot 38 has a top section 44 designed so that its basic shape has a shape corresponding to the internal, through-going, longitudinal cavity 37 in the foundation pile 36.

The uppermost part of the top section 44 is provided with a tapering shape 45, enabling easy positioning of the pile foot 38 in the lower part of the foundation pile 36. At the same time, this tapering shape 45 has another function, causing unfolding of the reinforcement members 47 when placing the reinforcement unit 46.

The reinforcement unit 46 includes an annular element 48 on which is mounted a number of reinforcement members 47 that each are provided in bent shape.

In this embodiment, the recesses 49 are placed internally in the pile foot 38. These recesses 49 are used for storing the free end 50 of the tension members 40 when the pile foot 38 is closely connected to the lower part of the foundation pile 36.

Figure 15:
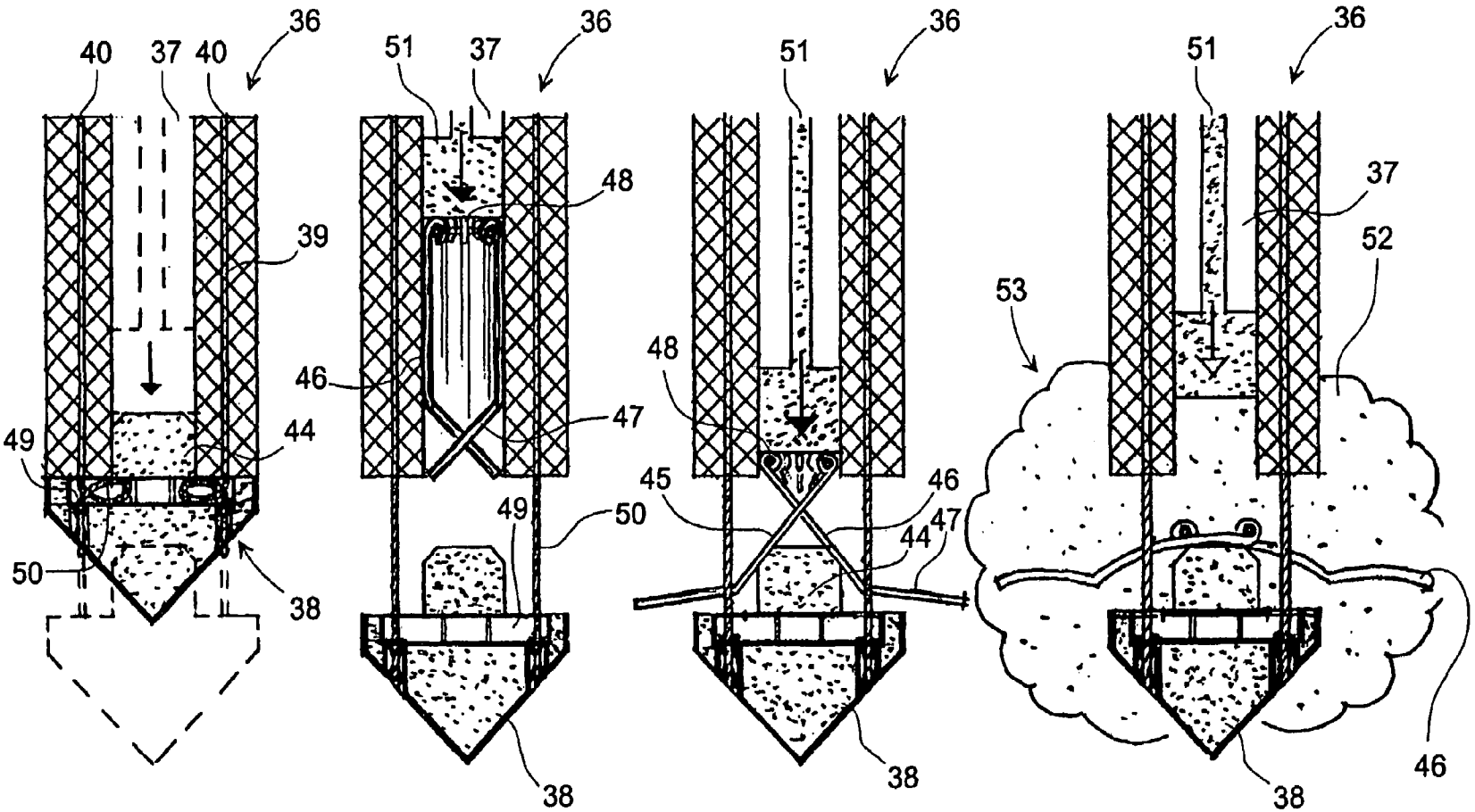
FIG. 15 shows how foundation pile and pile foot are mounted.

FIG. 15 shows four situations of a foundation pile 36 during mounting. Situation A (far left) shows how the pile foot 38 is closely connected to the foundation pile 36. It is furthermore seen that the top section 44 of the pile foot 38 is disposed internally of the through-going, longitudinal cavity 37. The free sections 50 of the tension members 40 are coiled in the recesses 49 in the pile foot 38. The broken lines mark an axial displacement of the pile foot 38 relative to the foundation pile 36 which is achieved by a force being applied, shown by the arrow, internally of the through-going cavity 37, pressing the pile foot 38 farther down so that the free sections 50 of the tension members 40 are extended.

Situation B shows how the pile foot 38 is pressed down relative to the bottom of the foundation pile 36 so that the free sections 50 of the tension members 40 are fully extended, implying that the free sections of the tension members 40 have been unfolded from the recesses 49.

A reinforcement unit 46 is pressed through the cavity 37, the unit 46 being an annular element 48 on which there is a number of curved reinforcement members 47. These reinforcement members 47 have a bend at one or more points so that the free ends of the reinforcement members 47 extend across the center line of the cavity 37.

Situation C in FIG. 15 shows how a piston 51 presses the reinforcement unit 46 down over the top section 44 of the pile foot 38. The tapering shape 45 of the top section 44 together with the bent shape of the reinforcement members 47 provide that a downwards pressure from the piston 51 on the annular element 48 forces the reinforcement unit 46 to open, so that the reinforcement members 47 are forced in radial direction relative to the centre line of the foundation pile 36.

Situation D on FIG. 2 shows how the cavity 36 is used for injecting a volume of filler material 52 so that the filler material 52 entirely or partially encloses the pile foot 38 and the fully unfolded reinforcement member 46 and the bottom of the lower part of the foundation pile 36.

The amount of filler 52 is to be of such extent that an enlarged footing element 53 for the foundation pile 36 is formed, so that the dimension of the footing element 53 formed by the filler 52 is larger than the dimension of the lower part of the foundation pile 36.

Figure 16:
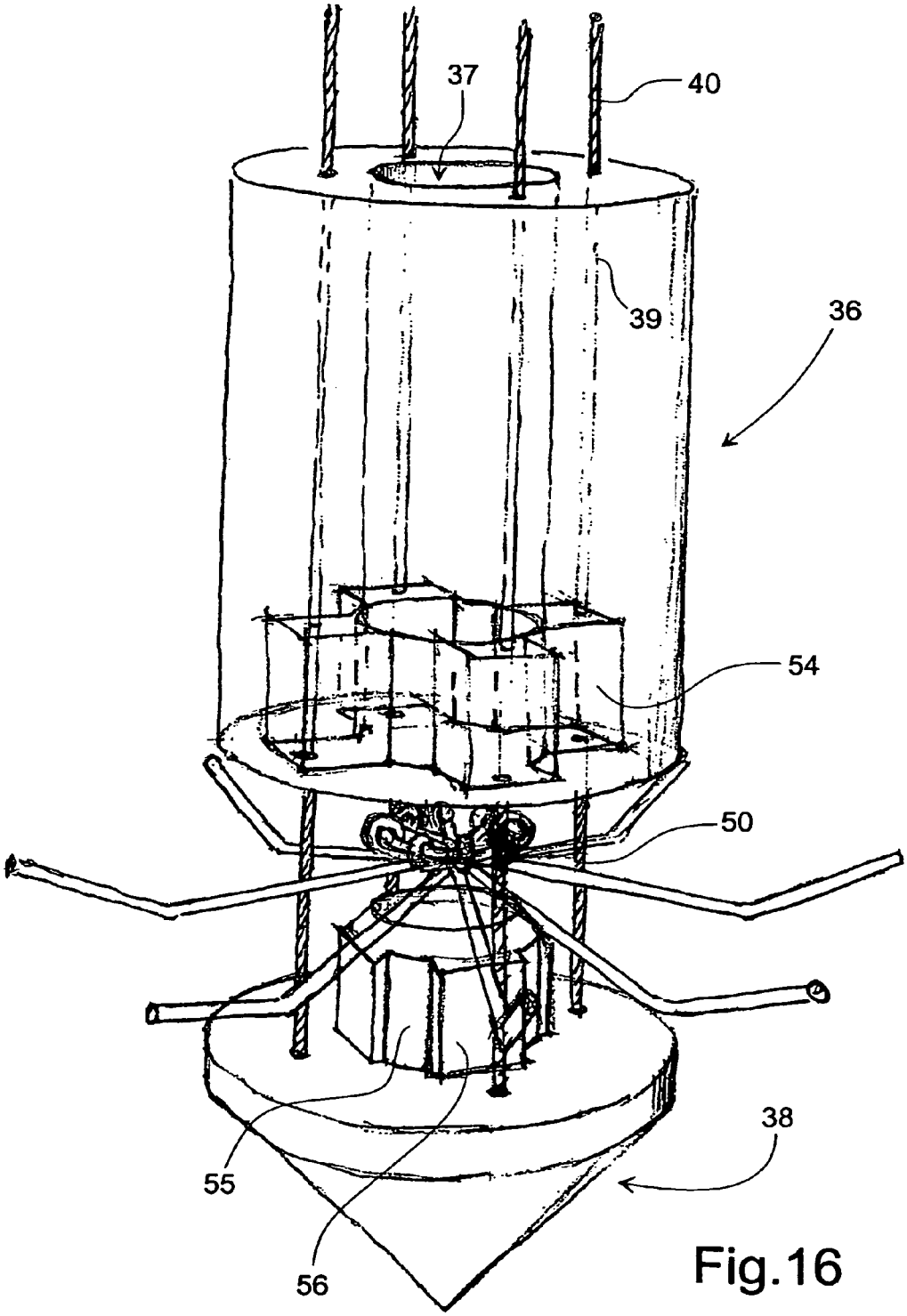
FIG. 16 shows an alternative embodiment of foundation pile, pile foot and reinforcement member.

FIG. 16 shows an alternative embodiment of the invention, where foundation pile 36 includes a through-going longitudinal cavity 37 and a number of longitudinal side ducts 39 in which there is a tension member 40 in each side duct 39.

In the lower part of the foundation pile 36 there are provided a number of recesses 54 in which the free sections of 50 of the tension members 40 may be coiled when the pile foot 38 is in close contact with foundation pile 36. The downwards tapering part of the pile foot 38 is completely smooth as there are no visible means for fastening the tension members 40 to the pile foot 38.

The top section 55 of the pile foot 38 is designed with a number of projections 56 that interact with the recesses 54 in the lower part of the foundation pile 36 so that the pile foot 38 is prevented from rotation during transport/mounting.

Figure 17:
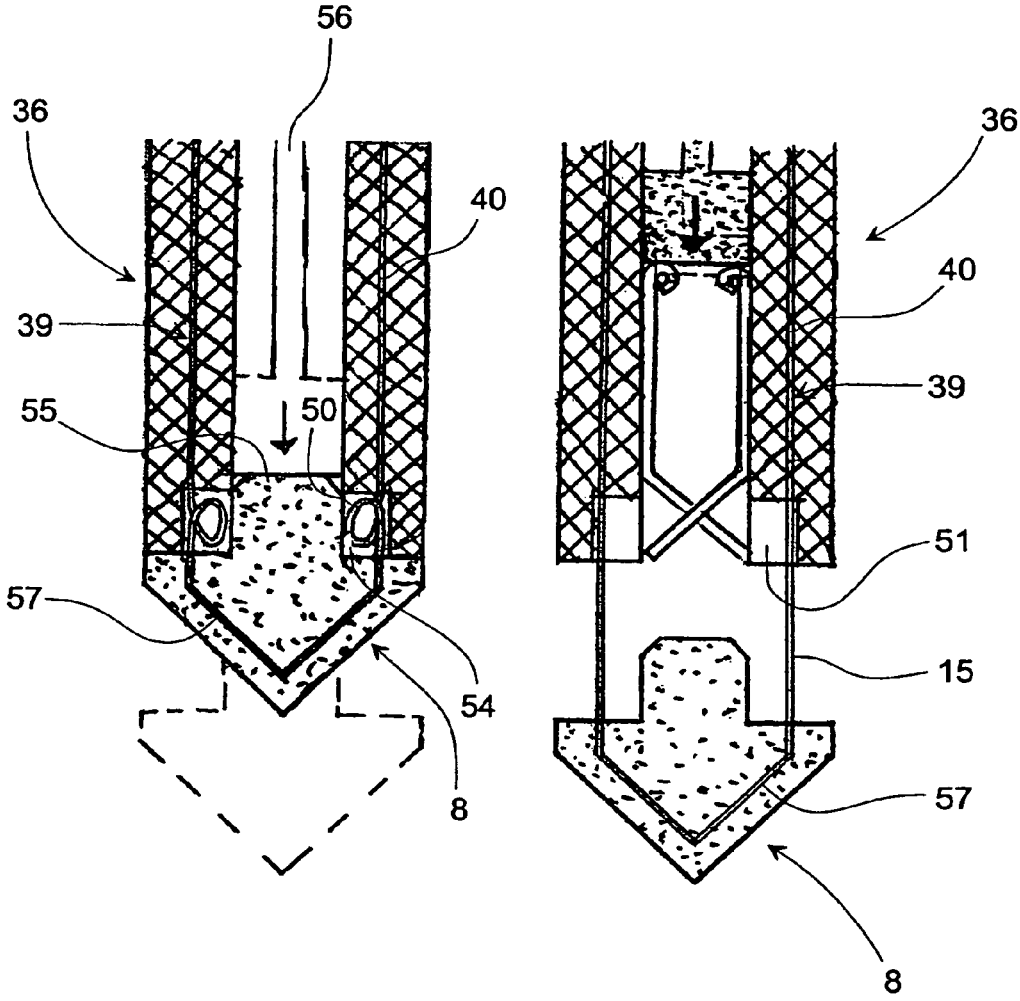
FIG. 17 shows how the above embodiment is mounted.

FIG. 17 shows the foundation pile 36 in two different situations during mounting of the foundation pile 36. The first situation shows how the pile foot 38 is closely associated with the foundation pile 36, and that the free section 50 of the tension member 40 is coiled in the recess 54 disposed at the bottom of the foundation pile 36.

By applying a piston 56 and downwards force on the top section 55 of the pile foot 38, the pile foot 38 will move down into the lowermost position shown by the broken line. Thereby, the free section 50 of the tension member 40 will be extended.

The means for securing the tension members 40 to the pile foot 38 is here a through-going duct 57 in the pile foot 38. This duct 57 is here of approximate V-shape. This enables a tension member 40 to be fitted in a side duct 39 in the foundation pile 36, extend down to the pile foot 38, be fitted through the duct 57 and up through an opposite side duct 39 in the foundation 36. This is seen more clearly in the last situation where the free section 50 of the tension members 40 is entirely extended and where the same tension member 40 goes down into one side duct 39 of foundation pile 39, down through the V-shaped duct 57 in the pile foot 38, and up through another side duct 39 in the foundation pile 36.

Figure 18:
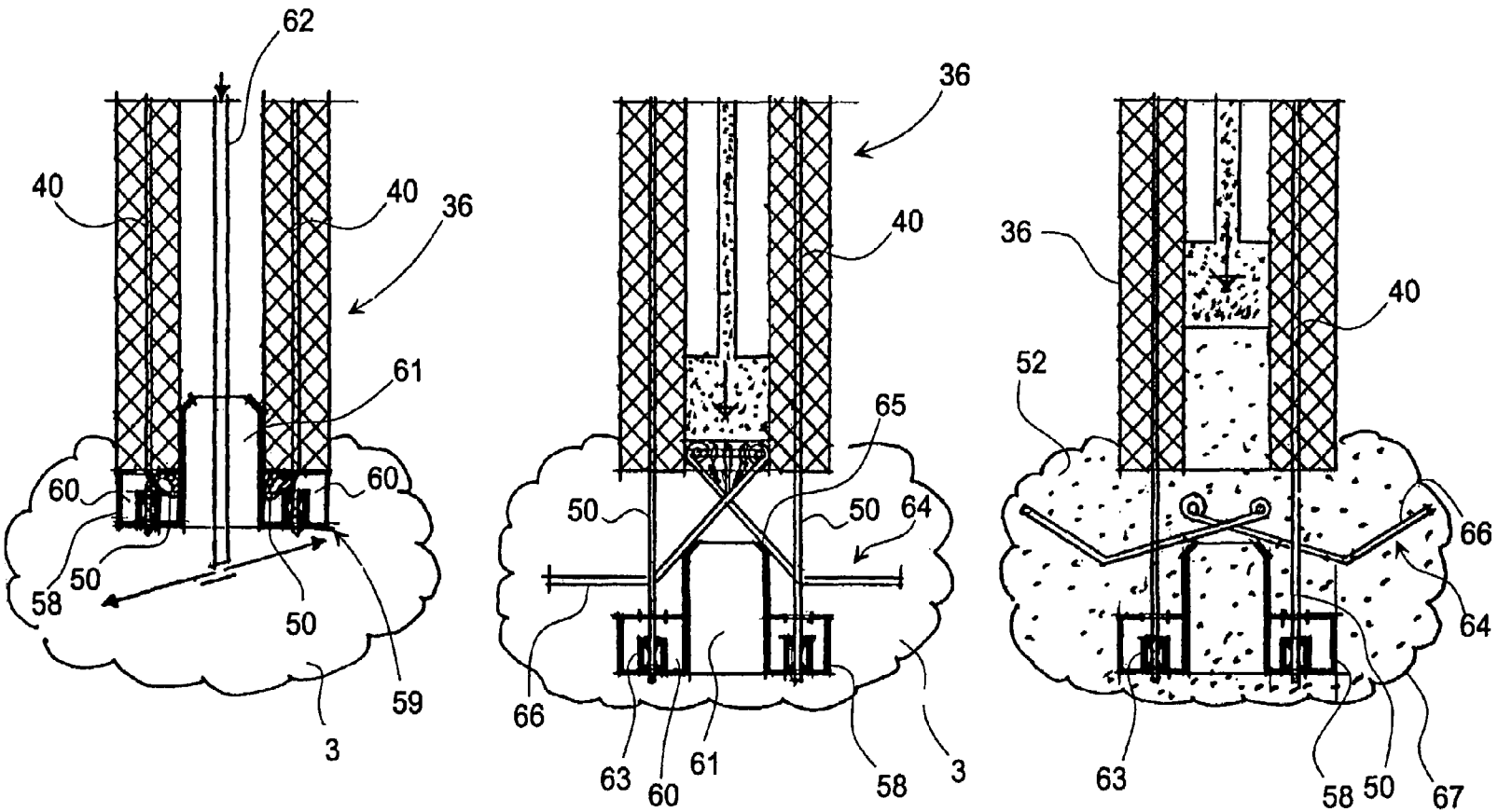
FIG. 18 shows how an alternative embodiment of the pile foot according to the invention is mounted.

FIG. 18 shows an alternative embodiment of the invention, where the pile foot 58 has a flat, disc-shaped bottom 59, where the outer diameter of this bottom 59 corresponds to the outer diameter of the foundation pile 36. Within the disc-shaped bottom 59 there is provided a number of recesses 60 in which the free sections 50 of the tension members 40 can be coiled when the pile foot 58 is closely connected to foundation pile 36.

In the shown embodiment, a pipe 62 is passed through the top section 61 of the pile foot 58 and the disc-shaped bottom 59, through which for example a cavity 3 may be flushed out under the pile foot 58.

In the next situation on FIG. 18, the pile foot 58 is disposed in the cavity 3, and the free sections 50 of the tension members 40 are extended. The means for fastening of the tension members 40 to the pile foot 58 in this embodiment are wire clamps 63 disposed in recesses 60 inside the pile foot 58, and which can be reached from the bottom of the pile foot 58.

Here, the reinforcement unit 64 is in a condition where it is pressed against tapered top section 65 of the pile foot 58.

The last situation on FIG. 18 shows that the cavity 3 has been filled with filler 52 which is here entirely enclosing the pile foot 58, the free sections 50 of the tension members 40, reinforcement members 66 and an a lower part of the foundation pile 36 for forming a footing element 67 having outer dimension greater than the outer dimension of the foundation pile 36.

Figure 19:
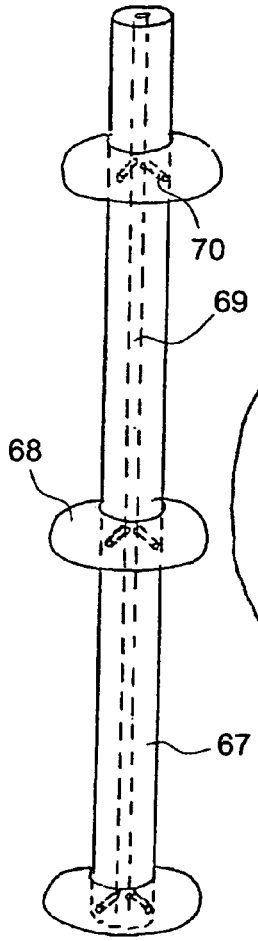
FIG. 19 shows a foundation pile with beads.
Figure 20:
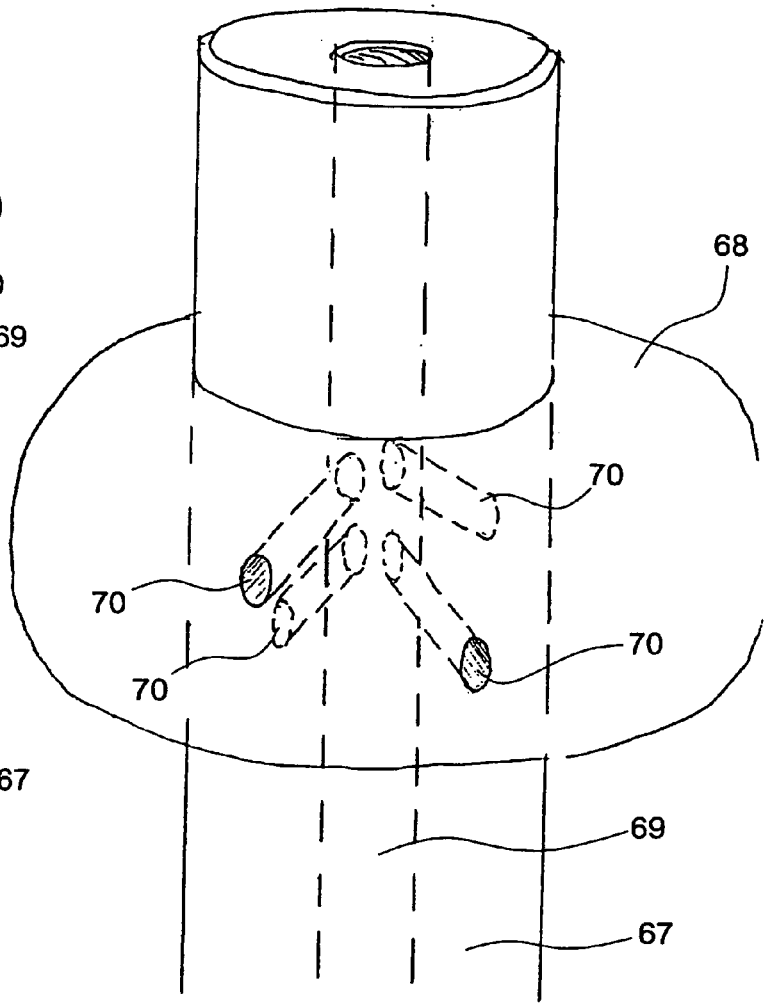
FIG. 20 shows an enlarged view of a foundation pile with filling ducts.

FIGS. 19 and 20 show a foundation pile 67 with beads 68 which are produced by injecting a filler material down through the through-going longitudinal cavity 69 and out through the filling ducts 70.

Figure 21:
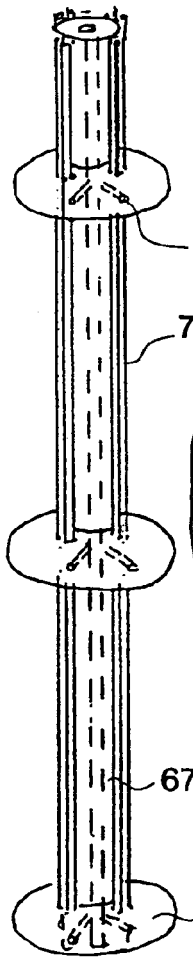
FIG. 21 shows a foundation pile with reinforcement and beads.
Figure 22:
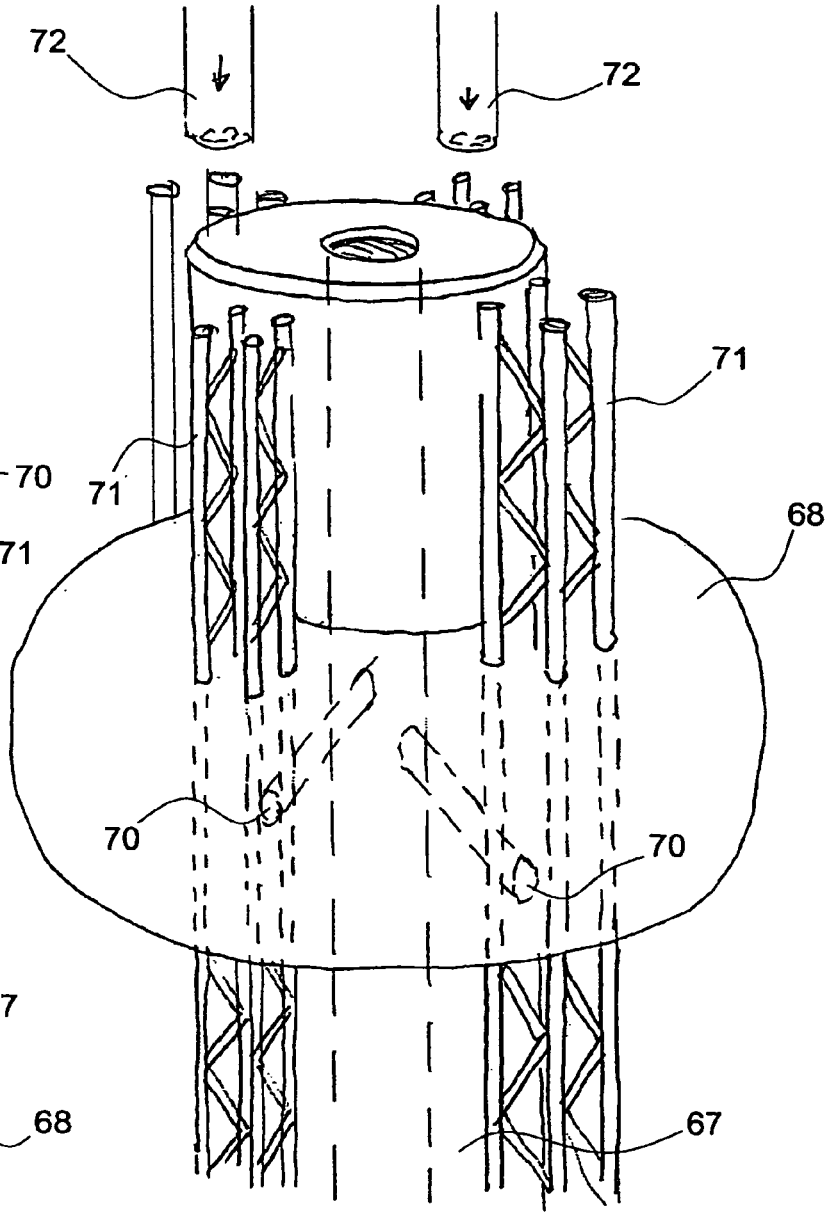
FIG. 22 shows an enlarged view of a foundation pile with reinforcement and filling ducts.

FIGS. 21 and 22 show a foundation pile 67 with external, cast reinforcements 71 thereon that may strengthen the foundation pile 67 and the beads 68.

The reinforcement 71 may furthermore be used as guide for vacuum tubes 72 that are immersed in the reinforcement 71, after which water or other liquid is pressed down, thereby flushing out earth which is sucked up through vacuum tubes 72. The flushing out of earth may occur opposite to the outlets of the filling ducts 70 so that it is possible to inject larger mass and thereby produce larger and stronger beads 68.

Figure 23A:
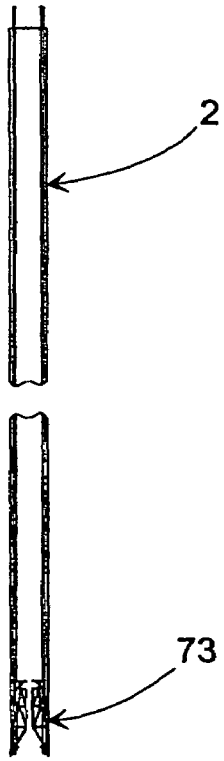
FIG. 23*a* shows an alternative embodiment of a reinforcement unit.
Figure 23B:
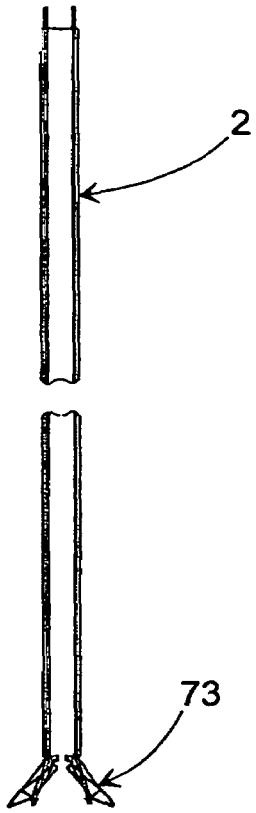
FIG. 23*b* shows the reinforcement unit of FIG. 23*a*.
Figure 23C:
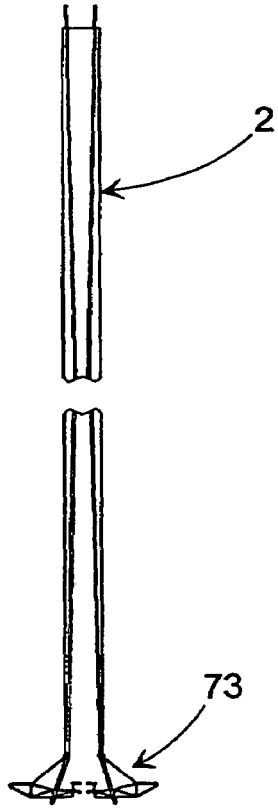
FIG. 23*c* shows the reinforcement unit of FIG. 23*a* in unfolded position.

FIGS. 23*a*, 23*b* and 23*c* show how an alternative embodiment of a reinforcement unit 73 is pressed down through a foundation pile 2 and is extended.

Figure 24:
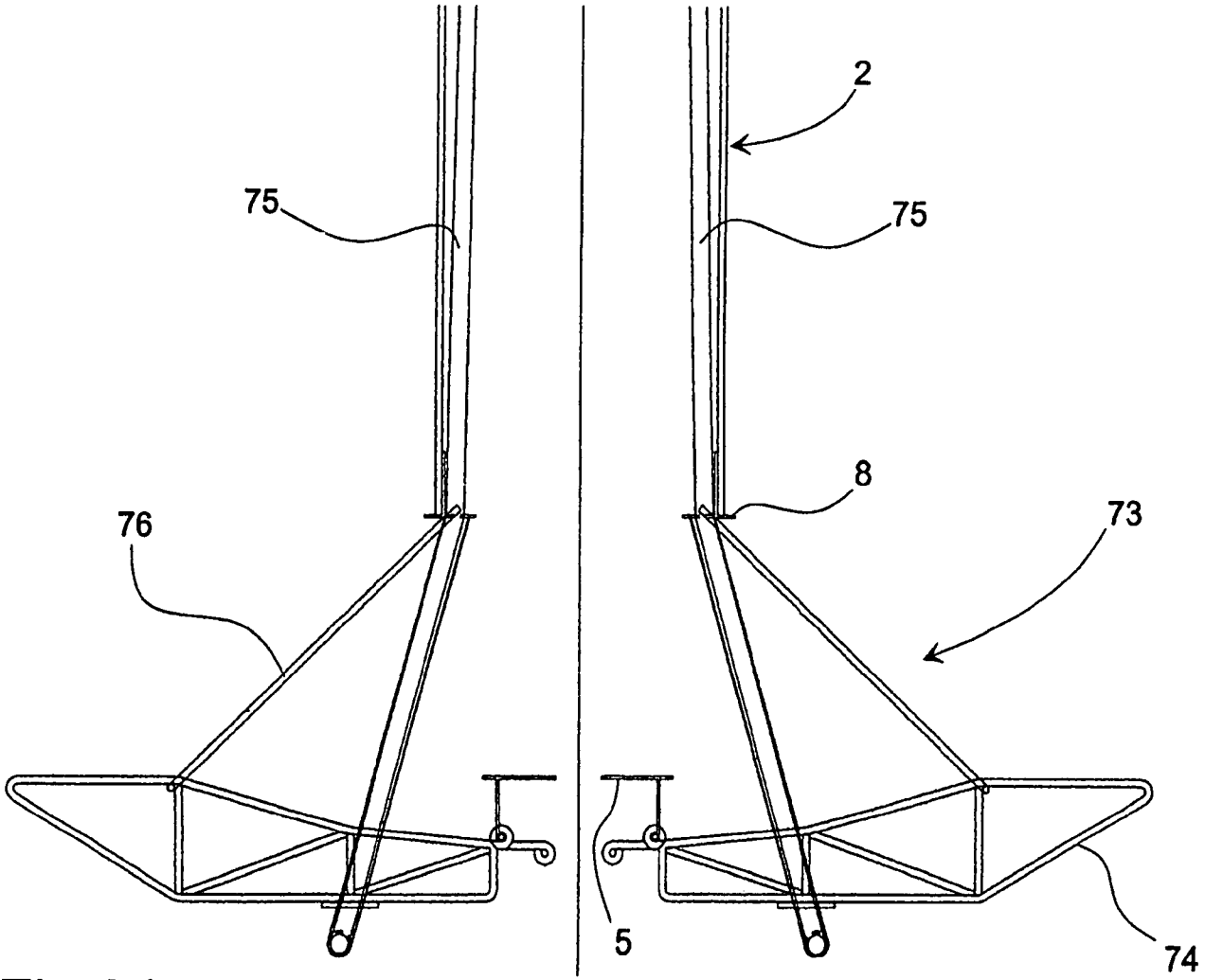
FIG. 24 shows an enlarged view of the reinforcement unit of FIG. 23*c*.

FIG. 24 shows the alternative embodiment of the reinforcement unit 73 that includes reinforcement members 74 pivotably connected with an annular element 5. In connection with the retainer elements 8, the tension members 75 are deflected when the reinforcement members 74 are unfolded. In order to control the reinforcement members 75 and to strengthen the reinforcement of the footing element (not shown), the reinforcement members 75 are connected with rods/wire 76 to either retainer elements 8 or tension members 75.

Figure 25:
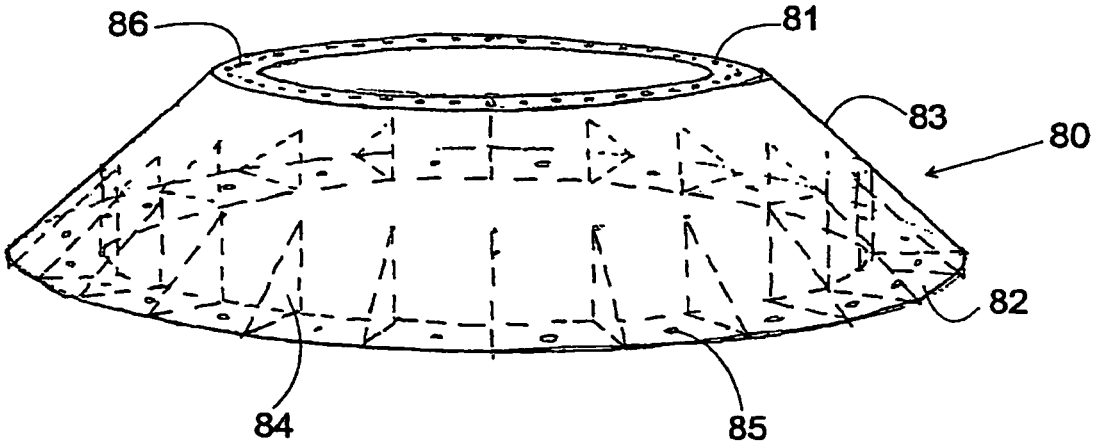
FIG. 25 shows an adapter.

FIG. 25 shows an adapter 80 that includes a second mounting ring 81 which is connected to a first underlying and larger mounting ring 82 outer ring with a continuous connecting member 83. Evenly distributed on the first mounting ring 82, reinforcement members 84 are mounted, connecting the internal side of the continuous connecting element 83 with the upper side of the first mounting ring 82.

On the first mounting ring 82, there are a number of holes 85 for mounting the adapter 80 against the foundation arrangement (not shown). The holes 85 and the reinforcement members 84 are evenly distributed around the first mounting ring 82 and placed so that the reinforcement members 84 are yielding the best static relief, and so that there is space for mounting/dismounting bolt/nut (not shown) in the holes 85.

On the second mounting ring 81, a number of holes 86 are evenly distributed for mounting the adapter 80 against a lower part (not shown) of a tower element.

The invention is not limited to the above described and illustrated embodiments shown in the drawings. Other embodiments containing other kinds of foundation piles, reinforcement units, reinforcement members, tension members, retainer elements and pile feet, as well as methods for placing a foundation pile and reinforcement of a footing element are comprised in the scope of the invention as specified in the claims.

The invention claimed is:

1. A foundation pile including a footing element which is reinforced with a reinforcement unit for reinforcing the footing element when laying pile foundations with the foundation pile and at least one through-going longitudinal cavity, comprising:

shaped and articulated reinforcement members that are pivotally connected to a centrally arranged, annular element, so that the reinforcement unit has a folded mounting position and an extended position of use, and the reinforcement unit is connected to the foundation pile by at least one tension member, wherein the reinforcement unit in the folded mounting position passes through the at least one through-going longitudinal cavity of the foundation pile, the footing element including a pile foot and the reinforcement unit or the pile foot being covered with the foundation pile with the at least one tension member, the at least one tension member including at least one free section between a lower edge of the foundation pile and the pile foot.

2. A foundation pile according to claim 1, wherein the at least one tension members comprises one of wires, cables, threaded rods or round bar iron with a bolt end.

3. A foundation pile according to claim 1, wherein the reinforcement unit includes pipes, wherein the at least one tension member is disposed through each pipe and fastened to a lower end of each pipe and at least one of the reinforcement member has a means for fastening the at least one tension member to one of the pipes.

4. A foundation piles according to claim 3, wherein the reinforcement unit includes retainer elements, the retainer elements being fastened to an upper end of at least one of the pipes and are provided with a cross-sectional shape with at least one retaining surface.

5. A foundation pile according to claim 3, including a whole or partial eye connection between one of the pipes and at least one of the reinforcement members.

6. A foundation pile according to claim 3, wherein the means for fastening is at least one of a bolt joint, a press joint or a weld.

7. A foundation pile according to claim 1, including retainer elements that are fastened to a joining arrangement in the at least one tension member and are provided with a cross-sectional shape with at least one retainer surface.

8. A foundation pile according to claim 7, comprising:

a connecting arrangement in the at least one tension member is one of a spigot-and-socket joint, a press joint or a plate and bolt joint.

9. A foundation pile according to claim 1, comprising:

means for expanding the reinforcement members, which is one of a spring ring, an eye connection, an explosion unit or a spreading element.

10. A foundation pile according to claim 1, wherein the reinforcement members are annular so that both ends of the reinforcement members are movably arranged around a centrally arranged annular element.

11. A foundation pile according to claim 1, wherein the foundation pile has at least one external reinforcement.

12. A foundation pile according to claim 1, wherein the reinforcement members are each shaped as a segment of a ring so that when the reinforcement unit is folded, a ring is formed corresponding to an inner diameter of the at least one through-going longitudinal cavity in the foundation pile, and when the reinforcement unit is expanded, a circular ring is formed having a diameter equal to or greater than a diameter of a bottom of the foundation pile.

13. A foundation pile according to claim 1, wherein the reinforcement members are formed by a network of rods or wires.

14. A foundation pile according to claim 1, wherein the foundation pile includes through-going, longitudinal side ducts disposed with substantially uniform spacing from a cross-sectional center of the foundation pile, each side duct being provided with one of the at least one tension member, each tension member being fastened downwards by means for fastening to the reinforcement unit including the pile foot, which is releasably connected to cylindric part of the foundation pile by the tension members.

15. A foundation pile according to claim 1, wherein recesses are provided in the pile foot or the lower part of a cylindric section of the foundation pile for accommodating a free section of the at least one tension members.

16. A foundation pile according to claim 1, wherein the means for fastening the at least one tension member to the pile foot is at least one of a bolt joint, a press joint, a sleeve, a casting or U-shaped duct provided inside the pile foot through which one of the at least one tension member may be passed.

17. A foundation pile according to claim 1, wherein the pile foot upwardly has a top element which corresponds in cross-sectional shape to at least one through-going longitudinal cavity, and the top element has a tapering shape upwardly which is symmetric about the center line of the pile foot.

18. A foundation pile according to claim 17, wherein a folded reinforcement unit is provided at a lower end of the through-going longitudinal cavity, including articulated reinforcement members that at one end are movably arranged a round a centrally arranged annular element, and a free end of each articulated reinforcement member is shaped so that an end at least projects over a center line of the top element of the pile foot.

19. A foundation pile according claim 1, wherein the pile foot is provided downwardly with a tapering shape or a flat disc shape.

20. A foundation pile according to claim 1, wherein the at least one through-going longitudinal cavity is connected at least one point with a outer side of the foundation pile by at least one transverse and downward directed filling ducts.

21. A foundation pile according to claim 20, wherein the at least one through-going longitudinal cavity of the foundation pile has a screw thread at an upper section.

22. A foundation pile according to claim 1, including an adapter formed with a first mounting ring for fastening to a foundation arrangement and a second mounting ring for fastening to a tower member, wherein the first and second mounting rings are connected with at least one connecting element.

23. A method for placing the foundation pile according to claim 1, wherein the footing element which is reinforced includes means for expanding the reinforcement members which is one of a spring ring, an eye connection, an explosion unit or a spreading element comprising placing the foundation pile in a position, by one of pressing, driving down, or by placing in pre-drilled holes, wherein one of the reinforcement units in a folded position pressed down through the at least one through-going longitudinal cavity in the foundation pile, when the reinforcement unit reaches the bottom of the foundation pile, the reinforcement unit is pressed a distance farther down, and the means for expanding the reinforcement members is activated, thereby forming a network of the reinforcement members, and a curable filler is pressed down through the at least one through-going longitudinal cavity in the foundation pile, so that a lower part of the foundation pile and the expanded reinforcement unit are cast together to the footing element which is reinforced with a larger dimension than a outer dimension of the foundation pile.

24. A method according to claim 23, wherein after placing the foundation pile, the pile foot is pressed or driven farther down with a piston or a driving tool, wherein a distance between the pile foot and a lower part of the foundation footing corresponds at the most to a length of a free section of the at least one tension member.

25. A method according to claim 23, wherein, before pressing a folded reinforcement unit down, there is formed a longitudinal cavity under a lower part of the foundation pile with a ground preparation unit.

26. A method according to claim 25, wherein the reinforcement unit, when reaching a bottom of the foundation pile, is pressed down into the cavity until retainer members at an upper part of the reinforcement unit fall to a position against an inner side of the foundation pile, and subsequently the reinforcement members are pulled to ensure that the reinforcement unit and a bottom of the foundation pile are joined.

27. A method according to claim 25, wherein the means for expanding the reinforcement members is a spring ring, so that pipes are pressed outwards, and the reinforcement member by an eye connection, is forced outwards, so that a network of the pipes, reinforcement members and a centrally arranged annular element is formed.

28. A method according to claim 25, wherein the means for expanding the reinforcement members is a spreading element arranged for controlling the reinforcement members of the reinforcement unit when falling outwards due to force of gravity when the reinforcement unit reaches the cavity under the foundation pile, so that a network of reinforcement members and the centrally arranged annular element is formed.

29. A method according to claim 25, wherein the expansion of the reinforcement members occurs when a piston is pressed down on an annular element of the reinforcement unit, after which the reinforcement members are passed through a connection mounted between pipes and the reinforcement members, whereby the reinforcement members are pressed outwards.

30. A method according to claim 25, wherein the means of expansion is an exploding unit, and the reinforcing members are pressed outwards as a consequence of an explosion of the exploding unit.

31. A method according to claim 25, wherein formation of a cavity in connection with a lower part of a cylindric foundation pile comprises:

passing a ground preparation unit down through one of the at least one through-going longitudinal cavity;

the ground preparation unit works a surrounding earth layer under the foundation pile;

a cavity is formed out from the foundation pile; and the ground preparation unit is drawn up through one of the at least one through-going longitudinal cavity.

32. A method according to claim 25, wherein curable filler is injected through one of the at least one longitudinal cavity and out through filler ducts connected therewith forming at least one beads around an outer circumference of the foundation pile.

33. A method according to claim 25, wherein liquid filler material is injected into the cavity under the foundation pile before placing the reinforcement unit and casting the footing element.

* * * * *